US005119552A

United States Patent [19]

Sutou et al.

[11] Patent Number: 5,119,552

[45] Date of Patent: Jun. 9, 1992

[54] METHOD FOR MANUFACTURING HEADER PIPE OF HEAT EXCHANGER

[75] Inventors: Naoyoshi Sutou; Toshiharu Shinmura, both of Takasaki, Japan

[73] Assignee: Sanden Corporation, Gunma, Japan

[21] Appl. No.: 656,800

[22] Filed: Feb. 19, 1991

[30] Foreign Application Priority Data

Feb. 16, 1990 [JP] Japan ..... 2-35634
Feb. 21, 1990 [JP] Japan ..... 2-38428
Mar. 7, 1990 [JP] Japan ..... 2-56198

[51] Int. Cl.[5] ..... F28F 9/16; B21D 53/00
[52] U.S. Cl. ..... 29/890.052; 29/890.053
[58] Field of Search ..... 29/890.038, 890.046, 29/890.049, 890.052, 890.053

[56] References Cited

U.S. PATENT DOCUMENTS 2,105,241 1/1938 Gazey ..... 29/890.052 X
2,983,167 5/1961 Huet ..... 29/850.052 X
4,234,041 11/1980 Melnyk ..... 29/890.052 X
4,770,240 9/1988 Dawson et al. .

FOREIGN PATENT DOCUMENTS 527341 6/1931 Fed. Rep. of Germany .
1159886 7/1958 France ..... 29/890.052
0167039 10/1983 Japan ..... 29/850.052
61-235698 10/1986 Japan .
63-49193 4/1988 Japan .
0944094 12/1963 United Kingdom ..... 29/890.052

*Primary Examiner*—Timothy V. Eley
*Attorney, Agent, or Firm*—Banner, Birch, McKie & Beckett

[57] ABSTRACT

A method for manufacturing a header pipe of a heat exchanger wherein a planar raw plate is bent to have a U-shaped cross section in a first bending step. Connection holes to which heat exchanger tubes are to be connected are opened directly on the curved portion of the U-shaped raw plate formed by the first bending step. Thereafter, the side portions of the U-shaped raw plate are bent inward to abut their terminal ends to each other. Since the connection holes are formed directly on the curved portion of the raw plate, the size and shape of a punch for opening the connection holes may be set to a size and shape corresponding to the size and shape of the end portions of the heat exchanger tubes. Thus, the desired connection holes can be formed easily and precisely. Even if a deformation occurs on the side portions of the U-shaped raw plate in the connection hole opening step, such a deformation can be corrected in a second bending step. Since only the side portions of the raw plate are bent in the second bending step and not the side portion of the raw plate having the connection holes, the connection holes which have been already formed are not distorted. Therefore, the desired connection holes can be formed with high accuracy.

15 Claims, 21 Drawing Sheets

METHOD FOR MANUFACTURING HEADER PIPE OF HEAT EXCHANGER

BACKGROUND OF THE INVENTION

1. Field of the Invention

The present invention relates to a method for manufacturing a header pipe of a heat exchanger for use as an evaporator or a condenser for an air conditioner, a radiator or heater core for a vehicle, or other type heat exchanger.

2. Description of the Prior Art

A typical conventional method for manufacturing a header pipe of such a heat exchanger is disclosed in JP-A-SHO 61-235698. In this conventional method, a planar raw plate for a header pipe is first bent into a cylindrical shape. The terminal ends of the opening side portions of the cylindrical raw plate are then brazed to each other. Thereafter, connection holes to which heat exchanger tubes are to be connected are opened on the surface of the cylindrical raw plate by punching.

However, since a pressing force due to a punching in such a conventional method is applied to portions other than the hole portion to be opened when the cylindrical raw plate is processed for punching the connection holes, a deformation is liable to occur on the header pipe. If such a deformation occurs, correction of the deformation is required, and the number of the processes for manufacturing the header pipe are thereby increased.

To solve this problem, the following manufacturing method has been proposed. Namely, connection holes for the heat exchanger tubes are first opened on a planar raw plate by punching. Thereafter, the punched raw plate is bent into a cylindrical shape. According to this method, the deformation of the header pipe can be prevented because the deformation caused by punching can be corrected when the punched raw plate is bent.

However, the heat exchanger tubes are inserted into the connection holes formed on the curved surface of the header pipe. In this manufacturing method, the size and shape of the connection holes opened on the planar raw plate must be determined by considering the size and shape of the connection holes which will be formed after the planar raw plate is bent. Therefore a high-accuracy processing is required for the punching. Moreover, even if the punching for the connection holes is performed with high accuracy, distortion of the connection holes is likely to occur in the successive bending process. Accordingly, it is difficult to make a header pipe with desired connection holes by this method.

In addition, a heat exchanger whose header pipe has therein at least one partition for turning a heat medium in the header pipe is also known. A typical conventional method for manufacturing such a header pipe is disclosed in Japanese Utility Model Laid-Open SHO 63-49193 as shown in FIG. 30.

In this conventional method, a hole 105 for receiving a partition plate 104, as well as connection holes 103 for heat exchanger tubes 102, are opened on a preformed cylindrical raw material 101 for defining a header pipe. Thereafter, heat exchanger tubes 102 are inserted into connection holes 103 and partition plate 104 is inserted into hole 105 from outside. The partition plate 104 is fixed in place temporarily. After the temporary fixing, partition plate 104 is formally fixed to cylindrical raw material 101 for a header pipe by brazing.

Thus, in the conventional method for manufacturing a header pipe with a partition, the processing for opening hole 105 for the insertion of partition plate 104 thereinto is necessary. Moreover, hole 105 must be formed of a size capable of receiving an inserting portion 106 of partition plate 104 into the hole 105. Namely, hole 105 is required to be of a size encompassing almost half of the circumference of cylindrical raw material 101. Therefore, brazing defects are likely to occur along hole 105 after insertion of the partition plate 104, which may cause leakage of a heat medium. Furthermore, since such a large hole 105 is formed in the wall of cylindrical raw material 101 for a header pipe, the strength of the header pipe is greatly decreased. Therefore, there is a fear that the cylindrical raw material 101 may be deformed when hole 105 is opened or when connection holes 103 are processed.

SUMMARY OF THE INVENTION

Accordingly, an object of the present invention is to provide a method for manufacturing a header pipe of a heat exchanger which can prevent the deformation of the header pipe, the distortion of connection holes, and form the connection holes with a desired size and in a desired shape.

Another object of the present invention is to provide a method for manufacturing a header pipe of a heat exchanger which does not require the formation of a large hole for the insertion of a partition, and wherein leakage of a heat medium and deformation of a raw material for the header pipe in the manufacturing process does not occur.

A further object of the present invention is to provide a method for manufacturing a header pipe of a heat exchanger which does not require the formation of a large hole for the insertion of a partition, which can temporarily fix the partition at a required position, and which prevents leakage of a heat medium and deformation of a raw material for the header pipe in the manufacturing process.

To achieve these objects, a method for manufacturing a header pipe of a heat exchanger according to the present invention is herein provided. In a first embodiment of a method for manufacturing a header pipe of a heat exchanger, the header pipe is formed as a cylindrical shape with a plurality of connection holes for receiving the heat exchanger tubes. The method comprises the steps of a first bending step for bending a planar raw plate to have a U-shaped cross section; a connection hole opening step for opening the connection holes on the curved portion of the raw plate formed by the first bending step; and a second bending step for bending the side portions of the raw plate inward to abut their terminal ends to each other.

In a second embodiment of a method for manufacturing a header pipe of a heat exchanger according to the present invention, the header pipe is formed as a cylindrical shape with a plurality of connection holes thereon for receiving heat exchanger tubes and with at least one partition therein for turning a heat medium in the header pipe. The method comprises the steps of: a first bending step for bending a planar raw plate to have a U-shaped cross section; a connection hole opening step for opening the connection holes on the curved portion of the raw plate formed by the first bending step; an inserting step for inserting the at least one partition into the inside of the curved portion of the raw plate so that the periphery of the at least one partition is brought into contact with the inner surface of the curved portion of the raw plate; and a second bending step for bending the side portions of the raw plate inward so that their terminal ends are abutted to each other and the inner surfaces of the opening side portions are brought into contact with the periphery of the at least one partition.

In a third embodiment of a method for manufacturing a header pipe of a heat exchanger according to the present invention, the header pipe is formed as a cylindrical shape with a plurality of connection holes thereon for receiving heat exchanger tubes and with at least one partition therein for turning a heat medium in the header pipe. The method comprises the steps of: a groove forming step for forming at least one groove, into which the periphery of the at least one partition is to be inserted, on one surface of a plane raw plate by protruding a part of the planar raw plate from the other surface of the planar raw plate; a first bending step for bending the planar raw plate to have a 0-shaped cross section; a connection hole opening step for opening the connection holes on the curved portion of the raw plate formed by the first bending step; an inserting step for inserting the at least one partition into the groove on the inner surface of the curved portion of the raw plate; and a second bending step for bending the side portions of the raw plate inward so that their terminal ends are abutted to each other and the periphery of the at least one partition is inserted into the groove formed on the inner surfaces of the opening side portions of the raw plate.

In a fourth embodiment of a method for manufacturing a header pipe of a heat exchanger according to the present invention, the header pipe is formed as a cylindrical shape with a plurality of connection holes thereon for receiving heat exchanger tubes and with at least one partition therein for turning a heat medium in the header pipe. The method comprises the steps of: a first bending step for bending a planar raw plate to have a U-shaped cross section; a connection hole opening step for opening the connection holes on the curved portion of the raw plate formed by the first bending step; a groove forming step for forming at least one groove, into which the periphery of the at least one partition is to be inserted, on the inner surface of the raw plate by protruding a part of the raw plate from the outer surface of the raw plate; an inserting step for inserting the at least one partition into the groove on the inner surface of the curved portion of the raw plate; and a second bending step for bending the side portions of the raw plate inward so that their terminal ends are abutted to each other and the periphery of the at least one partition is inserted into the groove formed on the inner surfaces of the side portions of the raw plate.

In a fifth embodiment of a method for manufacturing a header pipe of a heat exchanger according to the present invention, the header pipe is formed as a cylindrical shape with a plurality of connection holes thereon for receiving heat exchanger tubes and with at least one partition therein for turning a heat medium in the header pipe. The method comprises the steps of: a first bending step for bending a planar raw plate to have a U-shaped cross section; a groove forming step for forming at least one groove, into which the periphery of the at least one partition is to be inserted, on the inner surface of the raw plate by protruding a part of the raw plate from the outer surface of the raw plate; a connection hole opening step for opening the connection holes on the curved portion of the raw plate formed by the first bending step; an inserting step for inserting the at least one partition into the groove on the inner surface of the curved portion of the raw plate; and a second bending step for bending the side portions of the raw plate inward so that their terminal ends are abutted to each other and the periphery of the at least one partition is inserted into the groove formed on the inner surfaces of the opening side portions of the raw plate.

In the first embodiment of the present invention, the curved portion on which the connection holes are to be opened is formed in advance in the first bending step. The connection holes are then opened on this curved portion in the successive connection hole opening step. Since the connection holes are formed directly on the curved portion of the raw plate, the size and shape of a punch for opening the connection holes may be set to a size and shape corresponding to the size and shape of the end portions of the heat exchanger tubes. Therefore, required connection holes can be formed easily and precisely. Although a deformation may occur on the side portions of the U-shaped raw plate in the connection hole opening step, such a deformation can be easily corrected in the second bending step in which the side portions are bent inward to abut their terminal ends to each other. Further, since only the opening side portions of the raw plate are bent in the second bending step and the portion of the connection hole side of the raw plate is not bent, the connection holes which have been already formed are not distorted. Therefore, the desired connection holes can be formed with a high accuracy.

In the second embodiment of the present invention, the U-shaped raw plate is formed in the first bending step. The partition is inserted into the inside of the curved portion of the U-shaped raw plate in the inserting step. The side portions of the U-shaped raw plate are then bent inward so that the inner surfaces of the side portions are brought into contact with the periphery of the partition. Since the partition can be temporarily fixed at a required or free position in the raw plate, it is not required to form a large hole for inserting a partition thereinto as required in a conventional method. Therefore, the deformation of the header pipe accompanying the formation of the large hole or the brazing defect at the position of the large hole can be prevented.

In the third, fourth and fifth embodiments of the present invention, the groove, into which the periphery of the partition is to be inserted, is formed on the surface of the raw plate by protruding a part of the raw plate in the groove forming step. The periphery of the partition is inserted into the groove in the inserting step. In addition to the advantages set forth with respect to the second embodiment of the present invention, the partition can be temporarily fixed more easily and precisely by inserting the partition into the groove. Furthermore, the strength of the header pipe can be increased by the protrusion for forming the groove.

BRIEF DESCRIPTION OF THE DRAWINGS

Some preferred exemplary embodiments of the invention will now be described with reference to the accompanying drawings, which are given by way of example only, and are not intended to limit the present invention.

DETAILED DESCRIPTION OF PREFERRED EMBODIMENTS OF THE INVENTION

Figure 1:
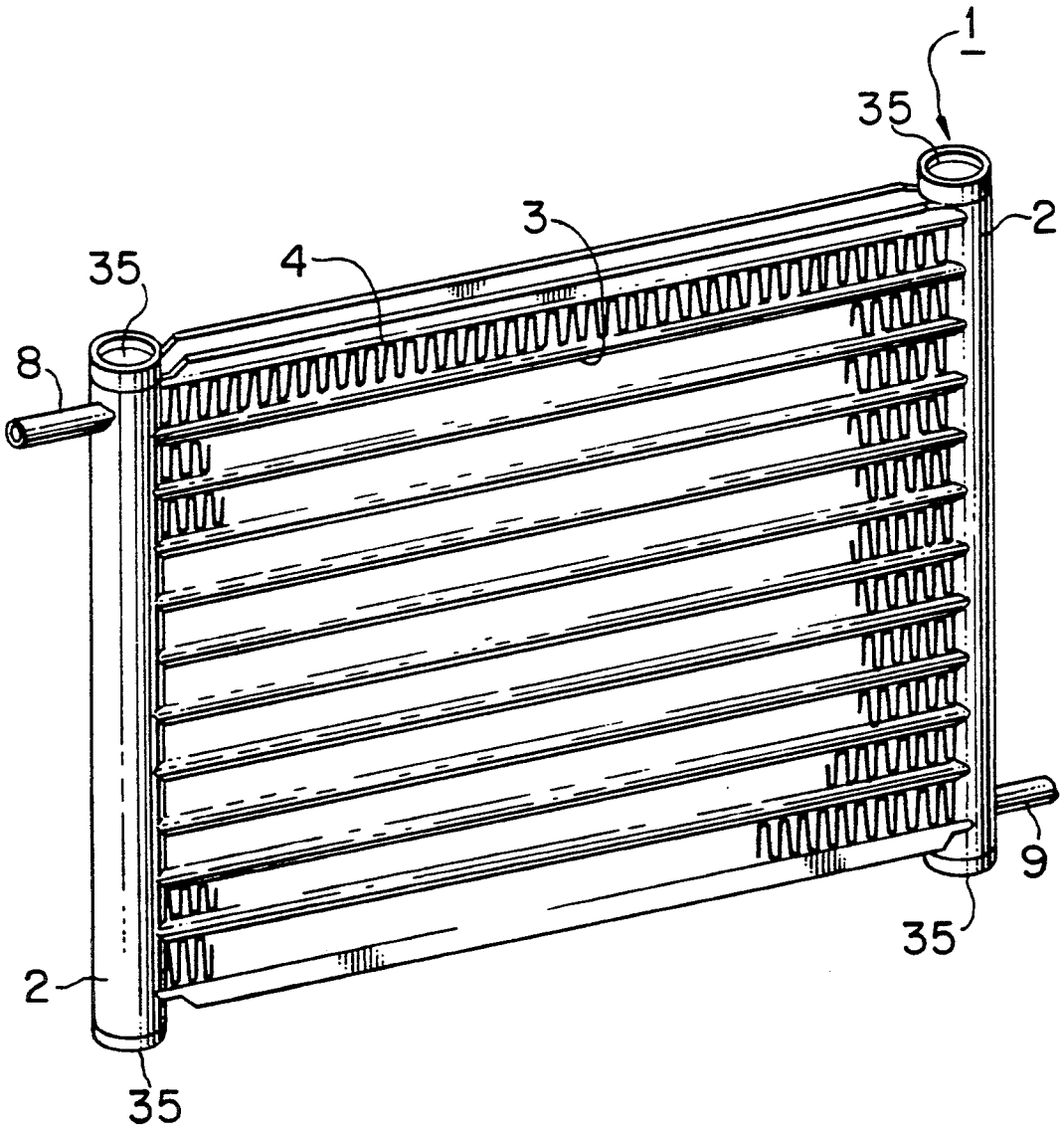
FIG. 1 is a perspective view of a heat exchanger having header pipes made in accordance with a first embodiment of a method of the present invention.

Referring to the drawings, FIGS. 1-8 illustrate a method for manufacturing a header pipe of a heat exchanger according to a first embodiment of the present invention, and the heat exchanger manufactured by the method. FIG. 1 illustrates a complete heat exchanger 1 used as a radiator for a vehicle. Heat exchanger 1 has a pair of header pipes 2 extending vertically in parallel relation to each other. A plurality of substantially parallel heat exchanger tubes 3 are disposed between the pair of header pipes 2 with a predetermined pitch in the vertical direction. Heat exchanger tubes 3 are connected to the pair of header pipes 2 at their end portions. A plurality of corrugate type radiation fins 4 are provided on the sides of heat exchanger tubes 3 and fixed to the tubes by, for example, brazing. An inlet tube 8 is connected to one of the header pipes 2 and an outlet tube 9 is connected to the other of the header pipes. A heat medium (for example, a cooling medium or a brine) is introduced through inlet tube 8, flows through header pipes 2 and heat exchanger tubes 3, and flows out of outlet tube 9. Heat exchanger 1 exchanges heat between the heat medium and the air passing through the portions of radiation fins 4 and between heat exchanger tubes 3.

Figure 2:
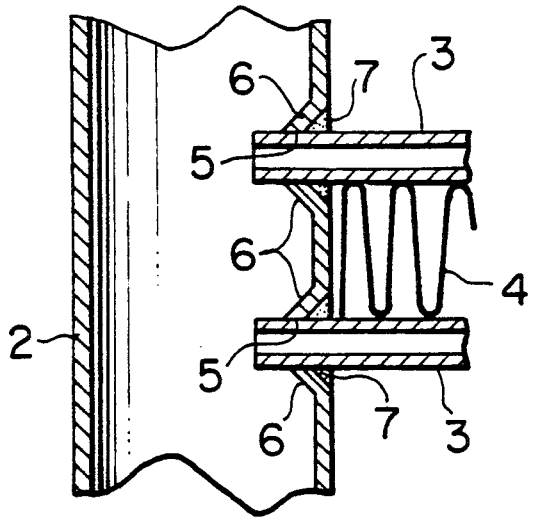
FIG. 2 is a vertical sectional view of a connection portion of a header pipe and heat exchanger tubes of the heat exchanger shown in FIG. 1.

FIG. 2 illustrates the connection state of a header pipe 2 and heat exchanger tubes 3. Each header pipe 2 has a plurality of connection holes 5 arranged in the longitudinal direction of the header pipe. Tapered portions 6 are bent inward and formed around each connection hole 5. The portion surrounding each tapered portion 6 remains unaffected. The end portion of each heat exchanger tube 3 is inserted into the corresponding connection hole 5. The heat exchanger tube is brazed to header pipe 2 by a brazing material 7 charged between tapered portions 6 and the heat exchanger tube.

Figure 4:
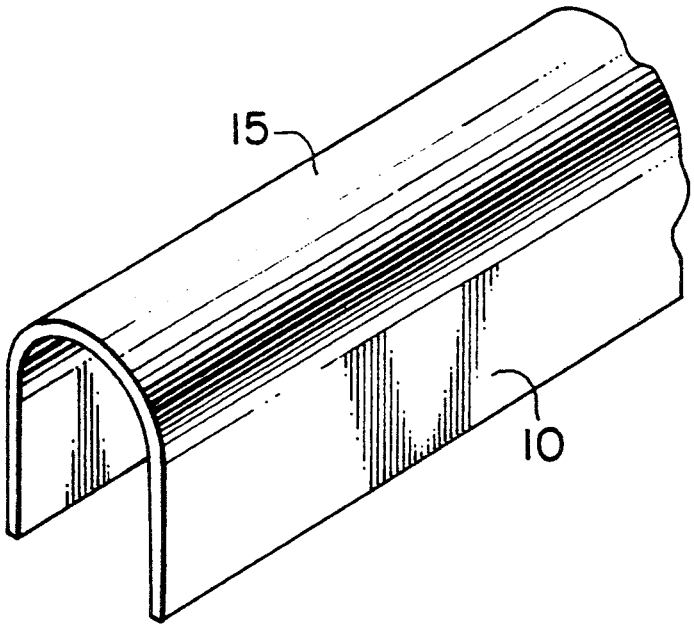
FIG. 4 is a perspective view of a raw plate after the first bending step shown in FIGS. 3A and 3B.
Figure 3A:
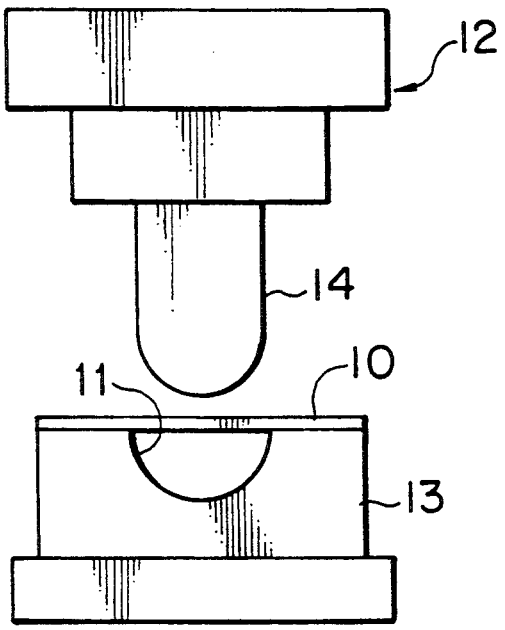
FIGS. 3A and 3B are side views showing a first bending step in the method according to the first embodiment of the present invention.
Figure 3B:
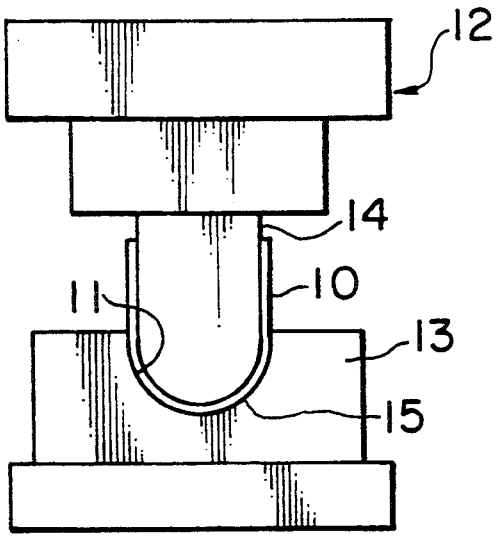

FIGS. 3A and 3B to 8 illustrate the method for manufacturing a header pipe of the heat exchanger according to the first embodiment of the present invention. FIGS. 3A and 3B illustrate a first bending step of the manufacturing method. Firstly, a planar raw plate 10 for header pipe 2 is prepared. Planar raw plate 10 is clad with a brazing material and has a length and a width corresponding to the length and the circumference of the header pipe 2 to be made. This planar raw plate 10 is placed on a die 13 of a press machine 12 which has a semicircular groove 11 as shown in FIG. 3A. The placed planar raw plate 10 is then pressed and bent to a U-shaped cross section by a punch 14 as shown in FIG. 3B. Thus, raw plate 10 can be formed to have a curved portion 15 as shown in FIG. 4.

Figure 5B:
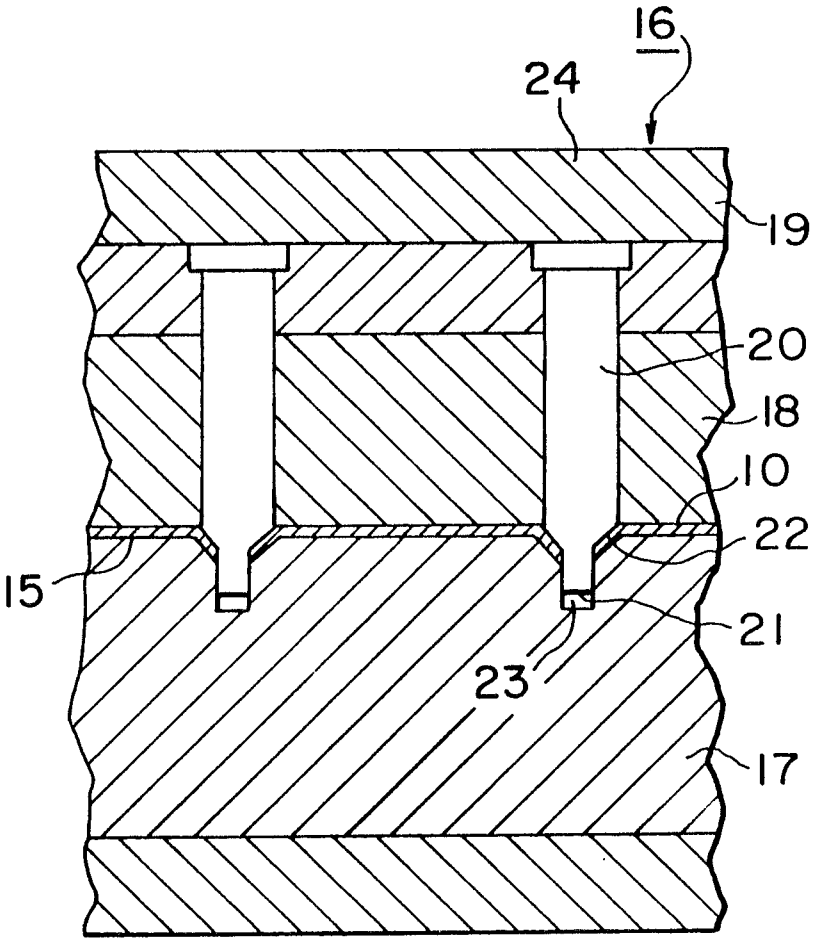
FIGS. 5A and 5B are vertical sectional views showing a connection hole opening step in the method according to the first embodiment of the present invention.
Figure 5A:
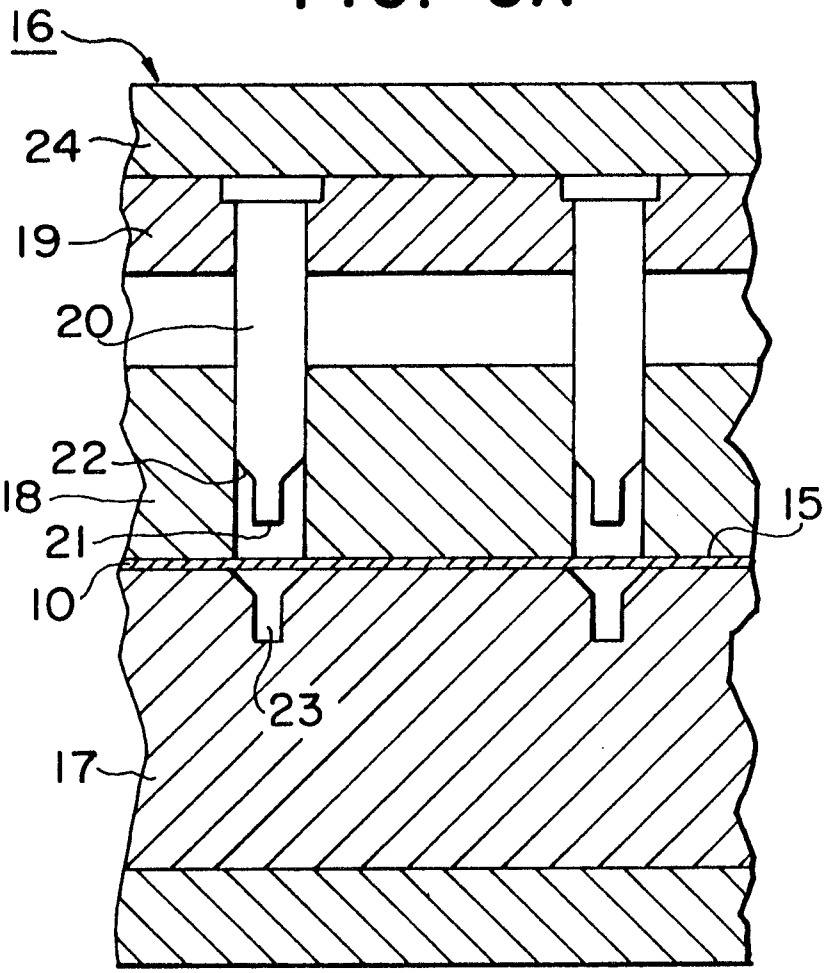

After the first bending step, the method proceeds to a step for opening connection holes as shown in FIGS. 5A and 5B. In this step, as shown in FIG. 5A, U-shaped raw plate 10 is inverted and placed on a die 17 of a press machine 16. Die 17 has an outer surface which is formed to correspond to the inner surface of the U-shaped raw plate. The outer surface of the U-shaped raw plate is held by a punch guide 18. Punches 20 for opening connection holes 5 are fixed to a punch holder 19. Each punch 20 has a cutting portion 21 for cutting curved portion 15 to open connection hole 5. Bending portions 22 are formed on the upper portions of cutting portions 21 of the punches by decreasing the width of cutting portions 21 gradually toward their lower portions. Bending portions 22 are for bending and forming tapered portions 6. Grooves 23 are provided on the top portion of die 17 at spaced intervals to accommodate the insertion of punches 20. The grooves 23 are formed to be similar in shape to cutting portions 21 and bending portions 22 of punches 20.

Figure 6:
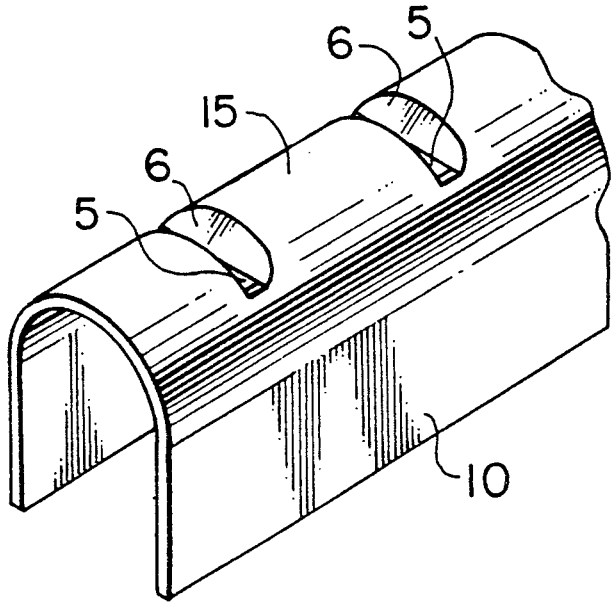
FIG. 6 is a perspective view of a raw plate after the connection hole opening step shown in FIGS. 5A and 5B.

Thereafter, as shown in FIG. 5B, an upper dieset 24 is moved downward, so that punches 20 are moved downward along punch guide 18, and cutting portions 21 and bending portions 22 of the punches 20 are inserted into respective grooves 23. At that time, connection holes 5 are opened by cutting portions 21, and tapered portions 6 are formed by bending portions 22. As a result, U-shaped raw plate 10 having connection holes 5 and tapered portions 6 on its curved portion 15 is obtained as shown in FIG. 6.

Figure 7A:
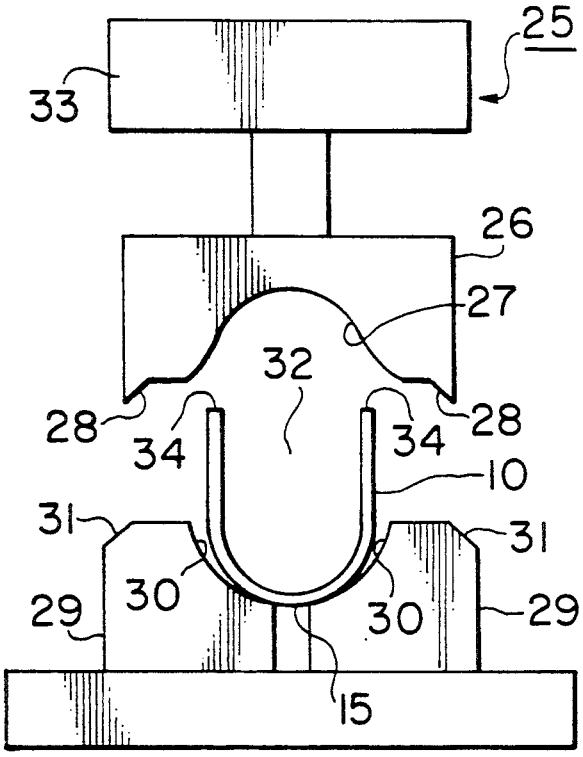
FIGS. 7A and 7B are side views showing a second bending step in the method according to the first embodiment of the present invention.
Figure 7C:
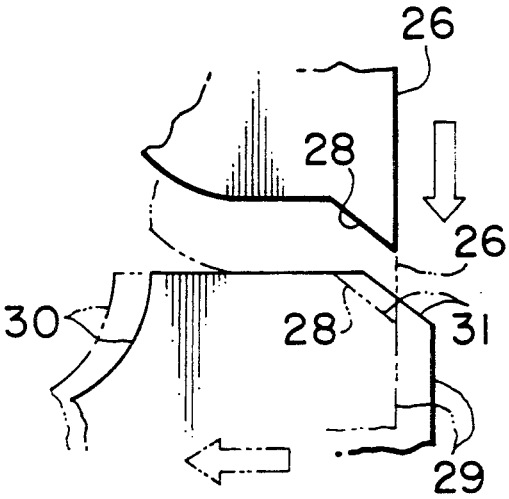
FIG. 7C is a fragmentary side view of an upper die and a movable die piece used in the second bending step shown in FIGS. 7A and 7B.
Figure 7B:
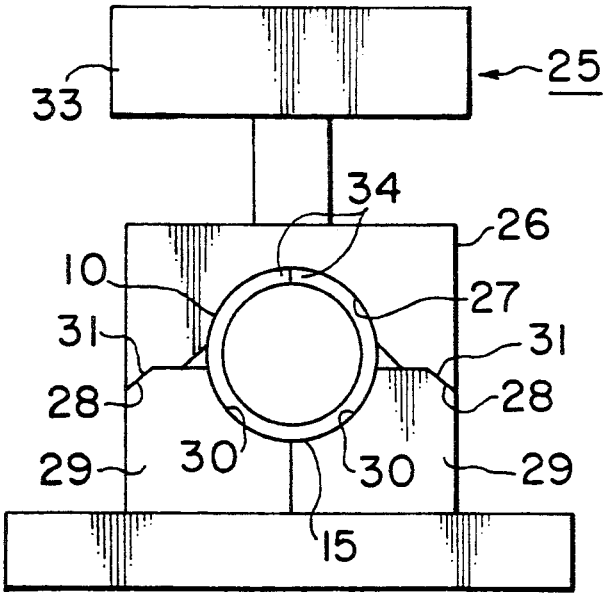

After the connection hole opening step, the method proceeds to a second bending step shown in FIGS. 7A and 7B. In this step, a press machine 25 is used as shown in FIGS. 7A and 7B. Press machine 25 comprises an upper die 26, an upper dieset 33 and a pair of movable die pieces 29 as an lower die. A semicircular groove 27, having an inner surface shape corresponding to the outer surface shape of header pipe 2, is formed at the central position of the lower surface of upper die 26. Inclined surfaces 28, extending in an oblique and downward direction, are formed on both edge portions of the lower surface of the upper die. An arc-shaped surface 30 is formed on the upper surface of each movable die piece 29. The arc-shaped surfaces 30 of the respective movable die pieces 29 are positioned to face each other. The two arc-shaped surfaces 30 of the respective movable die pieces 29 are shaped to correspond to the semicircular shape of the outer surface of header pipe 2. Each movable die piece 29 has an inclined guide surface 31 at its side edge portion of the upper surface. Each inclined guide surface 31 engages the corresponding inclined surface 28 of upper die 26.

In this second bending step, the curved portion 15 of U-shaped raw plate 10 is placed on the arc-shaped surfaces 30 of die pieces 29 such that opening 32 and side portions 34 of the raw plate are directed upward, as shown in FIG. 7A. Upper die 26 is then moved down by dieset 33.

As shown in FIG. 7C, inclined surfaces 28 of upper die 26 engage corresponding inclined guide surfaces 31 of the respective movable die pieces 29 during the downward motion of the upper die 26. This engagement causes the movable die pieces 29 to be moved toward each other. Because of this motion, movable die pieces 29 securely hold the curved portion 15 of U-shaped raw plate 10.

Figure 8:
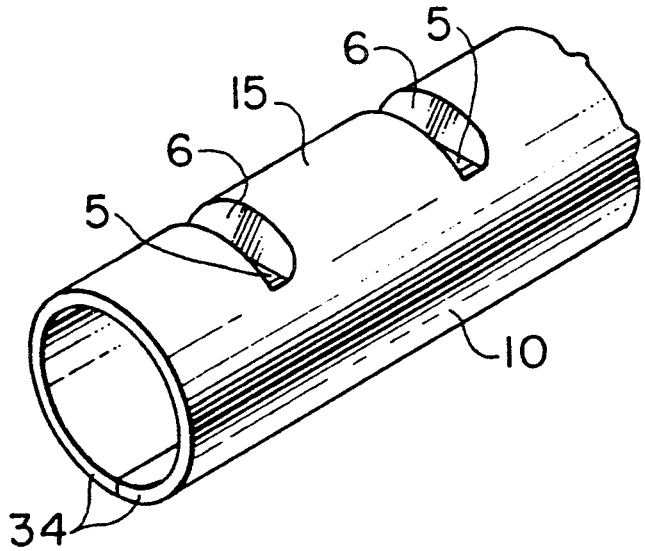
FIG. 8 is a perspective view of a raw plate after the second bending step shown in FIGS. 7A and 7B.

In addition, as shown in FIG. 7B, upper die 26 is moved downwardly to bend the side portions 34 of the raw plate inward. The inward bending of side portions 34 causes their to abut each other and thereby form the remaining semicircular shape of the header pipe. As a result, cylindrical raw plate 10 having connection holes 5 and tapered portions 6 is obtained as shown in FIG. 8.

After the second bending step, caps 35 (FIG. 1) are attached to the upper and lower ends of the formed cylindrical raw plate 10. Additionally, inlet tube 8 and outlet tube 9 are attached to the corresponding cylindrical raw plate 10. The obtained cylindrical raw plates 10 are deposited into a furnace, to fixedly attach the above parts and combine the abutted terminal ends of side portions 34 by brazing. This brazing process may be performed after inserting heat exchanger tubes 3 into connection holes 5 of header pipes 2 and interposing radiation fins 4 between the heat exchanger tubes.

Since curved portion 15 of raw plate 10 in this first embodiment of a method for forming a header pipe is formed in the first bending step and connection holes 5 are opened on the curved portion in the successive connection hole opening step, the connection holes are formed directly on the curved portion. Therefore, the size and shape of cutting portions 21 may be set corresponding to those of the end portions of heat exchanger tubes 3, and the processing can be performed easily and precisely.

Even if a deformation occurs on side portions 34 of raw plate 10 in the connection hole opening step, the deformation can be easily corrected in the second bending step.

Moreover, because only the side portions 34 of raw plate 10 are bent during the second bending step, and not the curved portion 15 on which connection holes 5 have been formed, the connection holes do not distort. Therefore, connection holes 5 of header pipe 2 can be formed precisely in a desired shape.

Furthermore, since tapered portions 6 are formed around connection holes 5, the tapered portions can guide the end portions of heat exchanger tubes 3 into the connection holes, to thereby facilitate the insertion and connection of the tubes. Since the circumferential or near portions of tapered portions 6 are held by punch guide 18, they are prevented from being deformed in the connection hole opening step so that they do not protrude toward radiation fins 4. Such prevention enables the heat exchange to be efficiently conducted even at these positions.

Figure 9:
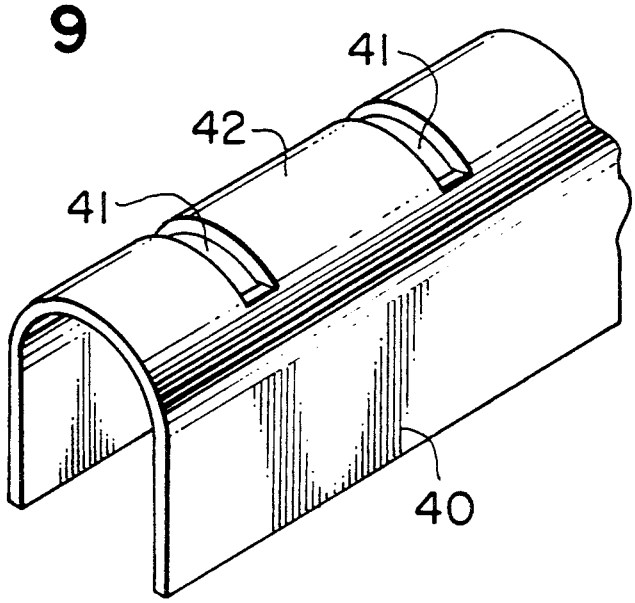
FIG. 9 is a perspective view of a raw plate for a header pipe after a first bending step according to a modification of the first embodiment of the present invention.

Although tapered portions 6 are preferably formed around connection holes 5 in the above embodiment, the present invention, of course, can be applied to a header pipe without such tapered portions. FIG. 9 shows a U-shaped raw plate 40 for such a header pipe after the connection hole opening step. Connection holes 41 are opened on curved portion 42 of U-shaped raw plate 40 so that they are positioned at the same level as the wall of the curved portion.

Figure 10:
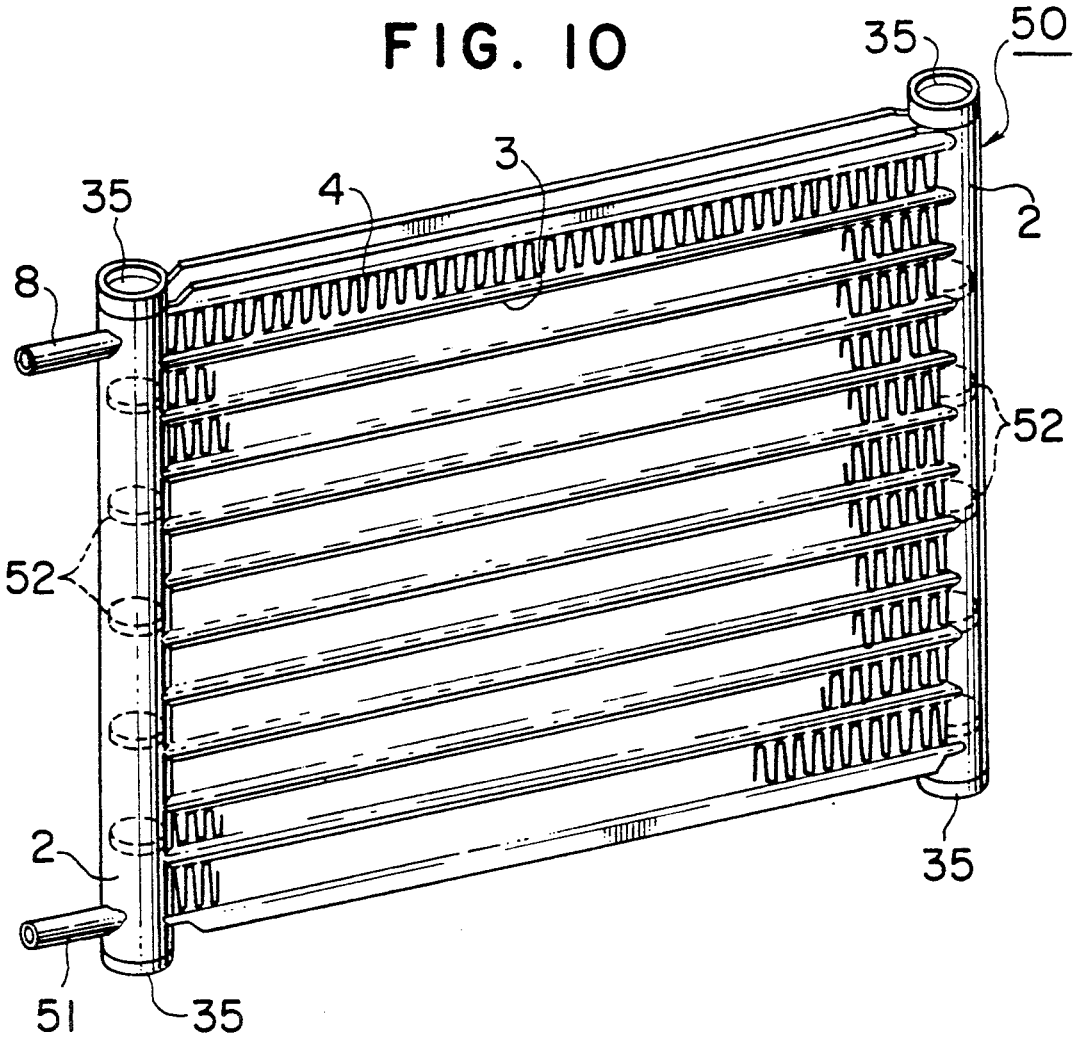
FIG. 10 is a perspective view of a heat exchanger having header pipes made in accordance with a second embodiment of a method of the present invention.

FIGS. 10–15 illustrate a method for manufacturing a header pipe of a heat exchanger according to a second embodiment of the present invention, and the heat exchanger manufactured by the method. FIG. 10 illustrates a second embodiment of a heat exchanger 50 used as a radiator for a vehicle. A pair of header pipes 2, a plurality of substantially parallel heat exchanger tubes 3, a plurality of corrugate type radiation fins 4, an inlet tube 8 and caps 35 have basically the same structures as those of heat exchanger 1 shown in FIG. 1; therefore, the same labels as those of FIG. 1 are attached to these elements. An outlet tube 51 is connected to the header pipe 2 to which inlet tube 8 is connected in this embodiment. Partitions (partition plates) 52 are provided in the respective header pipe 2. A heat medium is introduced through inlet tube 8, and flows through header pipes 2 and heat exchanger tubes 3 while its flow is turned in header pipes 2 by partitions 52 (i. e., the heat medium flows in heat exchanger 50 with a serpentine flow), and flows out of outlet tube 51.

Figure 11:
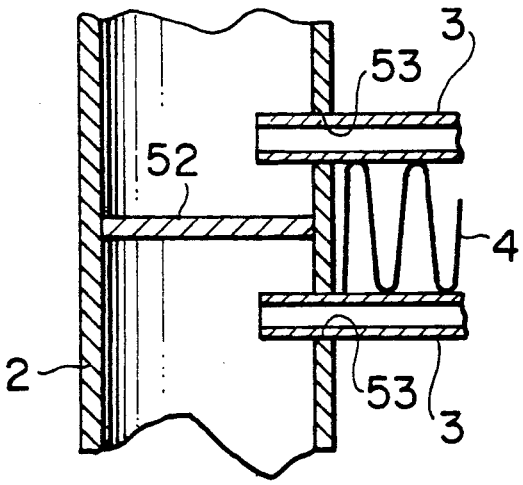
FIG. 11 is a vertical sectional view of a connection portion of a header pipe and heat exchanger tubes of the heat exchanger shown in FIG. 10.

FIG. 11 illustrates the connection state of header pipe 2 and heat exchanger tubes 3 and the installation state of a partition 52. Each header pipe 2 has a plurality of connection holes 53 arranged in the longitudinal direction of the header pipe. The end portion of each heat exchanger tube 3 is inserted into the corresponding connection hole 53. The heat exchanger tube is preferably fixed to header pipe 2 by brazing. Partition 52 is also preferably fixed in header pipe 2 at an appropriate position between heat exchanger tubes 3 by brazing.

Figure 12B:
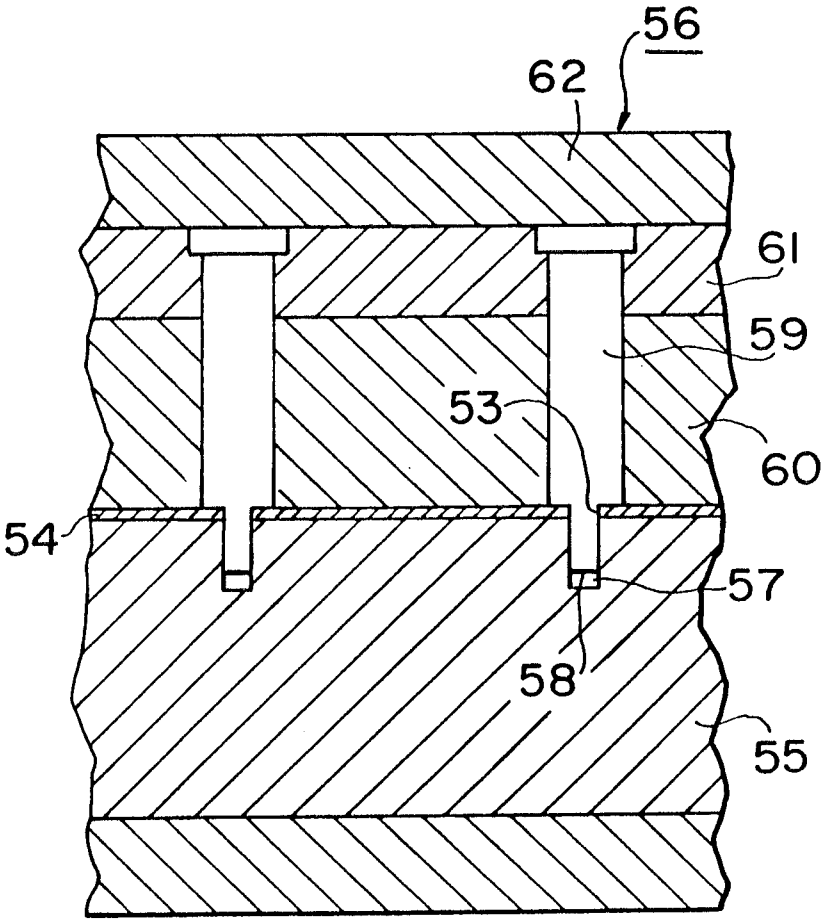
FIGS. 12A and 12B are vertical sectional views showing a connection hole opening step in the method according to the second embodiment of the present invention.
Figure 12A:
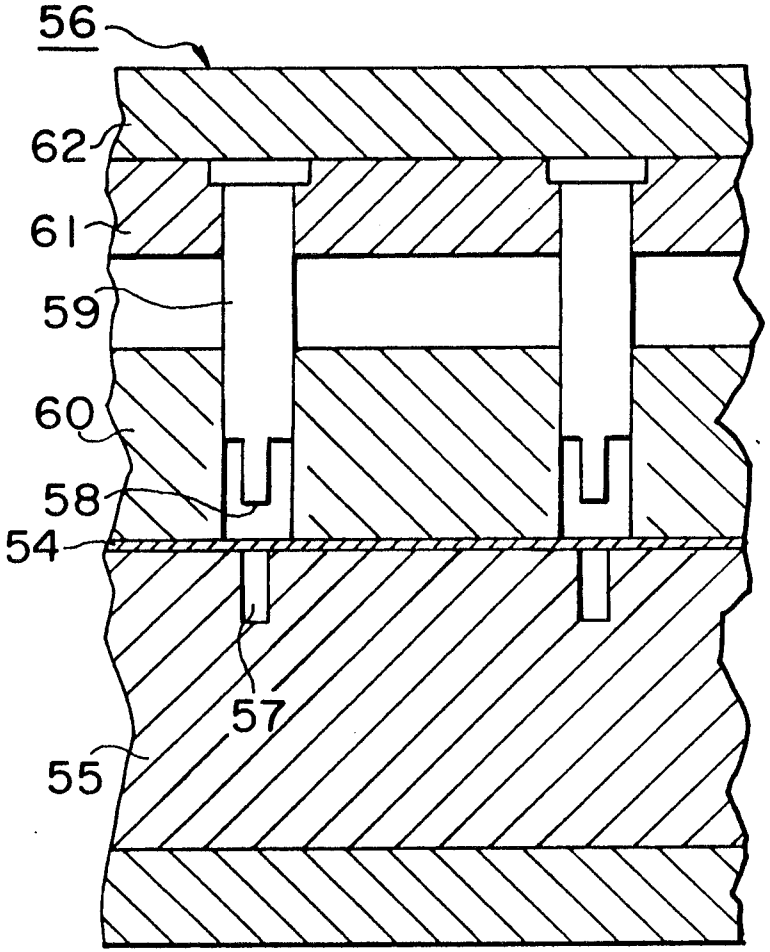

In this embodiment, a first bending step is substantially the same as that in the aforementioned first embodiment shown in FIGS. 3A and 3B. A U-shaped raw material having substantially the same structure as that shown in FIG. 4 is obtained. FIGS. 12A and 12B illustrate a connection hole opening step in the second embodiment. In this step, as shown in FIG. 12A, U-shaped raw plate 54 formed by the first bending step is placed on a die 55 of a press machine 56. Die 55 has an outer surface formed to correspond to the inner surface of the U-shaped raw plate and grooves 57 for to accommodate the insertion of the cutting portions 58 of punches 59. The outer surface of the U-shaped raw plate 54 is held by a punch guide 60. As shown in FIG. 12B, punches 59 fixed to a punch holder 61 are moved downwardly by the motion of a dieset 62. Cutting portions 58 of punches 59 cut the curved portion of U-shaped raw plate 54 to open connection holes 53. As a result, a U-shaped raw plate 54 having connection holes 5 similar to that shown in FIG. 9 is obtained.

Figure 13:
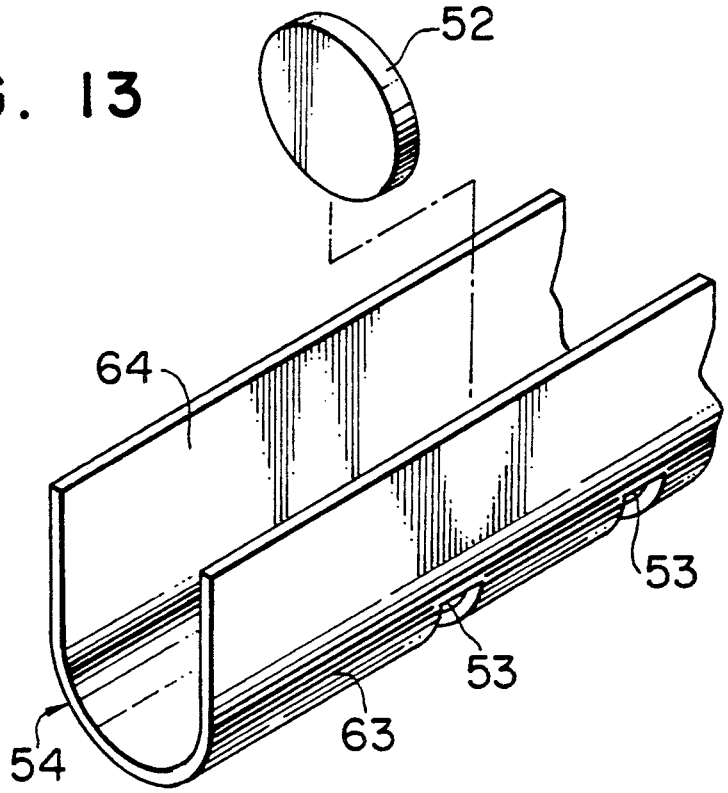
FIG. 13 is an exploded perspective view of a raw plate and a partition showing an inserting step in the method according to the second embodiment of the present invention.

After the connection hole opening step, the method proceeds to an inserting step for inserting partitions 52 into the inside of curved portion 63 of U-shaped raw plate 54 as shown in FIG. 13. Each partition 52 is inserted into the inside of curved portion 63 of U-shaped raw plate 54 through opening portion 64. The radius of this partition 52 is set to one slightly larger than the radius of curvature of curved portion 63. Therefore, partition 52 is inserted so that the periphery of the partition is pressed by the inner surface of U-shaped raw plate 54 between connection holes 53. By this insertion, partition 52 is temporarily fixed in U-shaped raw plate 54.

Figure 14A:
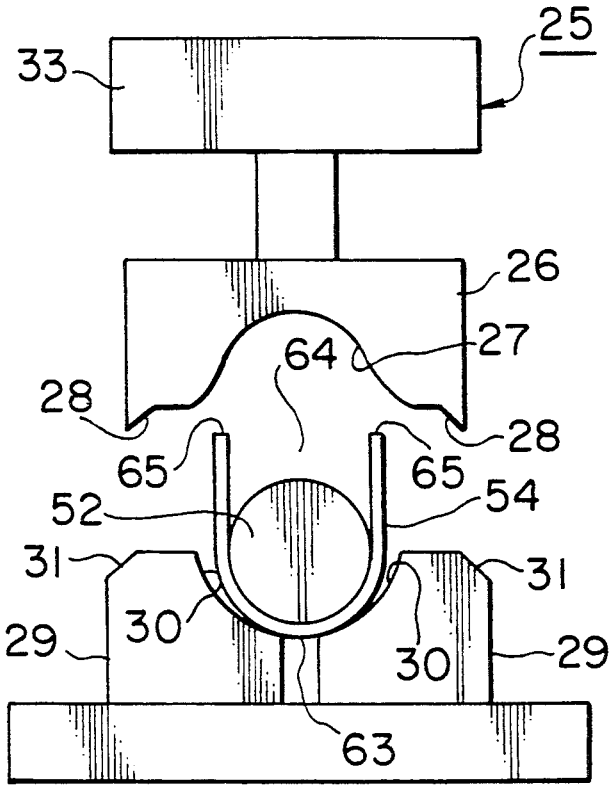
FIGS. 14A and 14B are side views showing a second bending step in the method according to the second embodiment of the present invention.
Figure 14B:
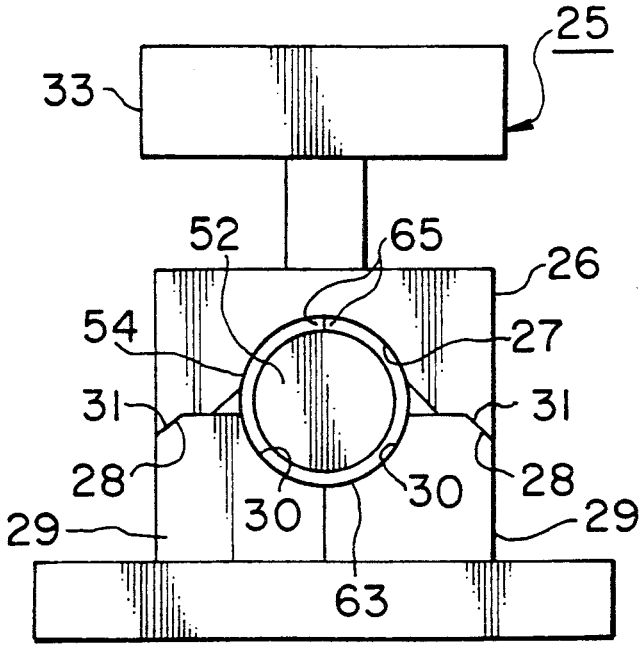
Figure 15:
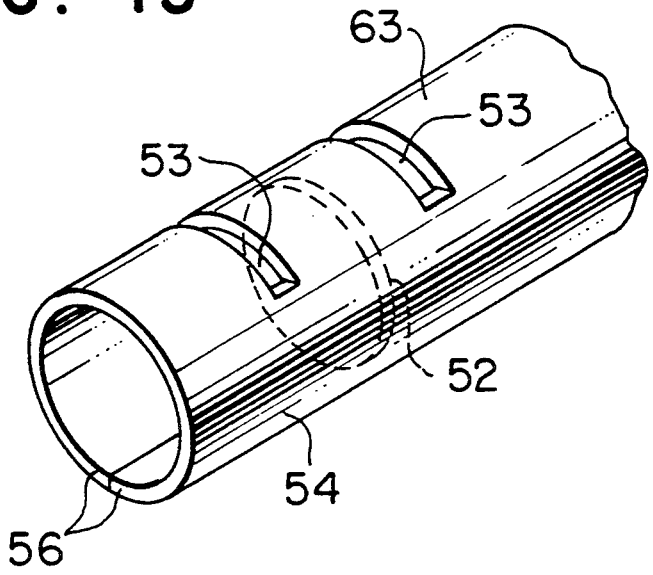
FIG. 15 perspective view of a raw plate after the second bending step shown in FIGS. 14A and 14B.

After the inserting step, the method proceeds to a second bending step as shown in FIGS. 14A and 14B. The press machine 25, which comprises upper die 26 with semicircular groove 27 and inclined surfaces 28, upper dieset 33, and a pair of movable die pieces 29 with arc-shaped surfaces 30 and inclined guide surfaces 31, has substantially the same structure as that of the press machine shown in FIGS. 7A and 7B. Therefore, the same labels as those of FIGS. 7A and 7B are attached to these elements shown in FIGS. 14A and 14B. In the second bending step, side portions 65 of U-shaped raw plate 54 are bent so that their terminal ends abut each other to form the cylindrical shape of the header pipe. Inserted partitions 52 are temporarily fixed in the raw plate 54 by the pressing operation of upper die 26 and movable die pieces 29. As a result, cylindrical raw plate 54 having connection holes 53 thereon and partitions 52 therein is obtained as shown in FIG. 15.

Also in this second embodiment, since curved portion 63 of raw plate 54 is formed in the first bending step and connection holes 53 are opened directly on the curved portion in the successive connection hole opening step, the connection holes can be formed easily and precisely. Even if a deformation occurs on side portions 65 of raw plate 54 in the connection hole opening step, the deformation can be easily corrected in the second bending step.

Moreover, because partitions 52 are temporarily fixed in the raw plate 54 by the inserting step and the successive second bending step without opening holes for insertion of partitions from outside as in the conventional method, the deformation of the header pipe and the brazing defects at the partition insertion holes can be surely prevented.

Figure 16:
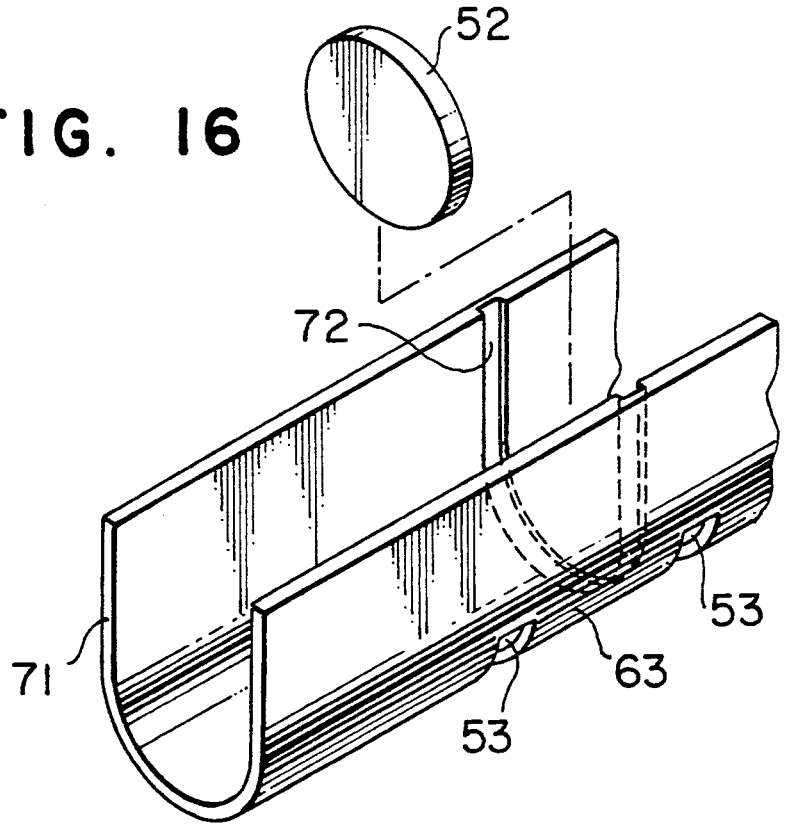
FIG. 16 is an exploded perspective view of a raw plate and a partition showing an inserting step according to a third embodiment (i.e., a modification of the second embodiment) of the present invention.

FIG. 16 illustrates another inserting step according to a modification of the second embodiment. In this embodiment, a planar raw plate 71 having grooves 72 (i.e., at least one groove) extending across the plate on one surface of the plate is used for a header pipe. FIG. 16 illustrates U-shaped raw plate 71 after the first bending step and the connection hole opening step. Partition 52 is inserted into the inside of the U-shaped raw plate 71 so that the periphery of the partition is inserted into the groove 72. In such a manner, groove 72 can position partition 52 in the longitudinal direction of the header pipe more easily and precisely, and the partition can be temporarily fixed more surely.

FIGS. 17A–17E illustrate other partitions according to modifications of the second embodiment.

Figure 17A:
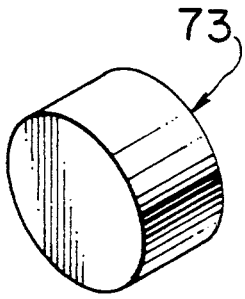
FIGS. 17A to 17E are perspective views of partitions according to modifications of the second embodiment of the present invention.

In FIG. 17A, a partition 73 is formed as a columnar block so that the width of the partition can be enlarged. Since the contact area between partition 73 and the inner surface of the raw plate is enlarged, the partition can be fixed more strongly and surely.

Figure 17B:
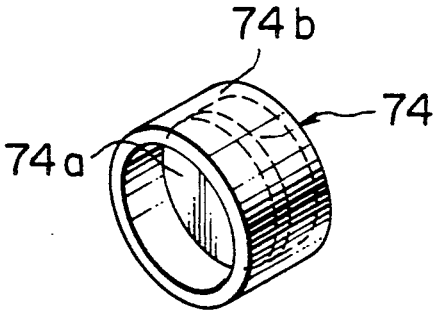

In FIG. 17B, a partition 74 comprises a partition plate **74*a* and a guide pipe 74*b* provided on the periphery of the partition plate. The contact area between partition 74 and the inner surface of the raw plate is enlarged by guide pipe 74*b*, and the partition can be fixed more strongly and surely, similarly to the above modification shown in FIG. 17A**.

Figure 17C:
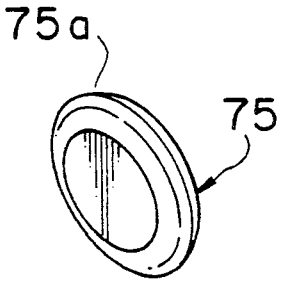

In FIG. 17C, a partition 75 is formed as a circular plate whose periphery **75*a* is formed as a semi-oval in cross section. This shape of the periphery 75*a* of partition 75** presses into the inner surface of the raw plate in the inserting step. Therefore, the second bending step, the partition can be temporarily fixed more strongly and surely.

Figure 17D:
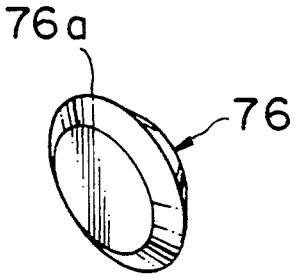

In FIG. 17D, a partition 76 is formed as a circular plate whose periphery 76*a* is formed as a triangle in cross section. The edge of periphery 76*a* of partition 76 is formed to be sharp. Therefore, the periphery presses into the inner surface of the raw plate more easily in the inserting step and the second bending step. Thus, the partition can be temporarily fixed more strongly and surely.

Figure 17E:
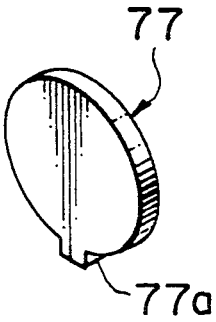
Figure 18:
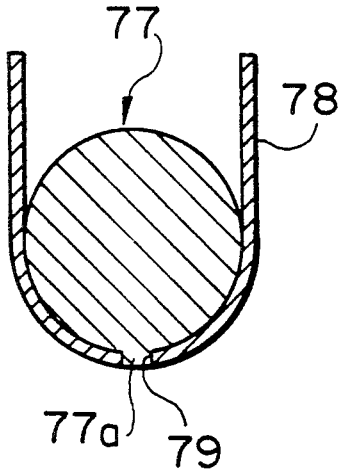
FIG. 18 is a vertical sectional view of a raw plate and the partition shown in FIG. 17E after the inserting step.

In FIG. 17E, a partition 77 is formed as a circular planar plate having a projection 77*a* on its periphery. In addition, a hole 79 is opened in raw plate 78 for receiving projection 77*a* as shown in FIG. 18. Partition 77 is positioned more precisely by inserting its projection 77*a* into hole 79 in the inserting step. Because the size of hole 79 for positioning partition 77 is small, the strength of the header pipe does not significantly decrease and brazing defects do not occur at this portion.

Figure 19:
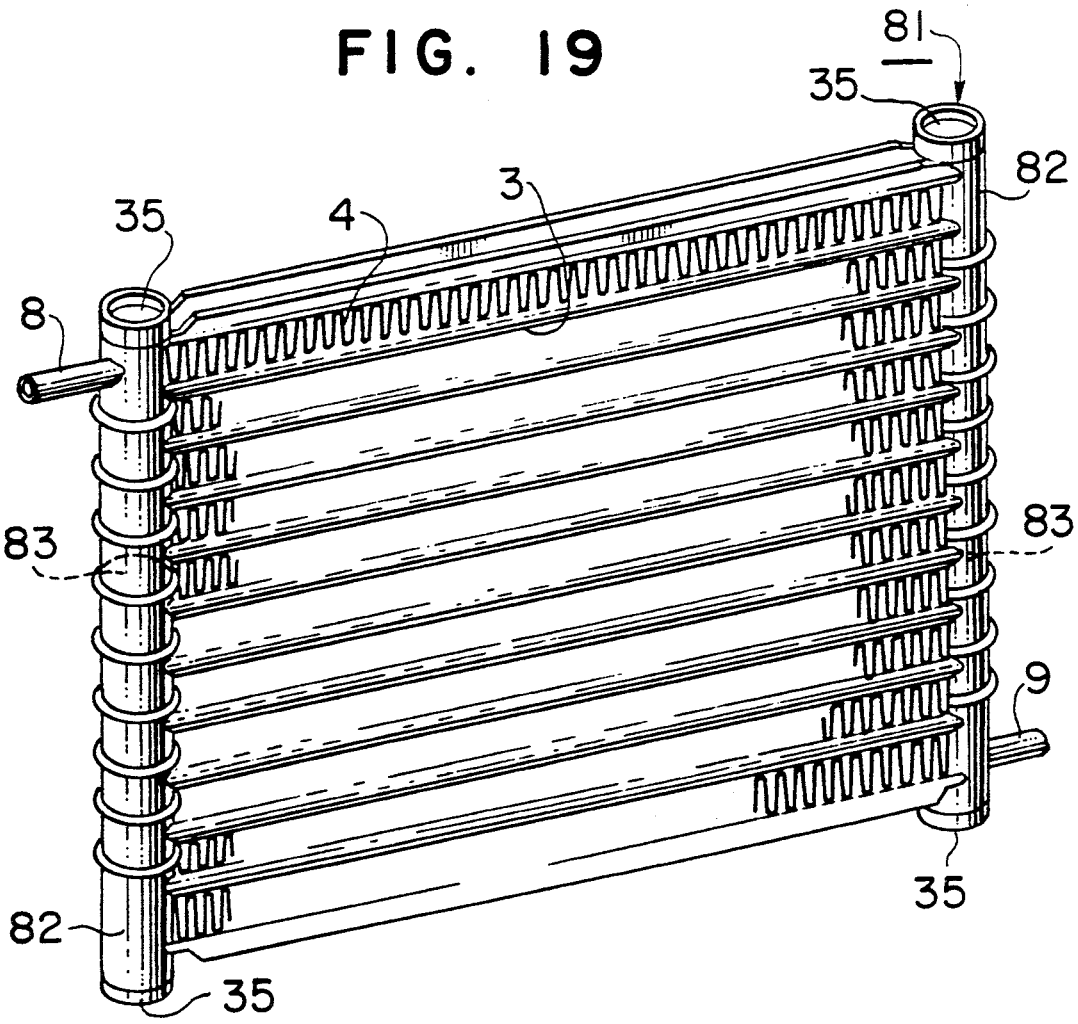
FIG. 19 is a perspective view of a heat exchanger having header pipes made in accordance with fourth and fifth embodiments of a method of the present invention.

FIGS. 19–28 illustrate a method for manufacturing a header pipe of a heat exchanger according to a third embodiment of the present invention, and the heat exchanger manufactured by the method. FIG. 19 illustrates a third embodiment of a complete heat exchanger 81 used as a radiator for a vehicle. Heat exchanger 81 includes a plurality of substantially parallel heat exchanger tubes 3, a plurality of corrugate type radiation fins 4, an inlet tube 8, an outlet tube 9 and caps 35 which have basically the same structures as those of heat exchanger 1 shown in FIG. 1. Therefore, the same labels as those of FIG. 1 are attached to these elements. Each header pipe 82 has grooves 85 (FIG. 20), into which respective partitions 83 are inserted, at positions between each pair of heat exchanger tubes 3. Partitions (partition plates) 83 are provided at appropriate positions in grooves 85 in the respective header pipe 82. A heat medium is introduced through inlet tube 8, and flows through header pipes 82 and heat exchanger tubes 3 while its flow is turned in header pipes 82 by partitions 83 (i. e., the heat medium flows in heat exchanger 81 with a serpentine flow), and flows out of outlet tube 9.

Figure 20:
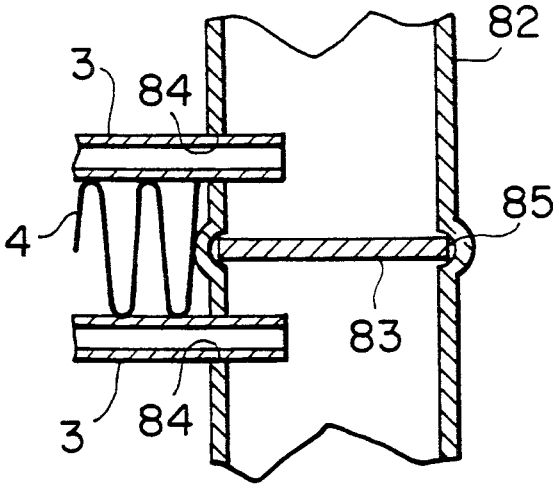
FIG. 20 is a vertical sectional view of a connection portion of a header pipe and heat exchanger tubes of the heat exchanger shown in FIG. 19.

FIG. 20 illustrates the connection state of a header pipe 82 and heat exchanger tubes 3 and the installation state of a partition 83. Each header pipe 82 has a plurality of connection holes 84 arranged in the longitudinal direction of the header pipe. The end portion of each heat exchanger tube 3 is inserted into the corresponding connection hole 84. The heat exchanger tube is preferably fixed to header pipe 2 by brazing. Partition 83 is fixed in header pipe 2 at a position where groove 85 is formed. Preferably, the periphery of the partition is inserted into the groove and fixed in the groove by brazing.

Figure 21B:
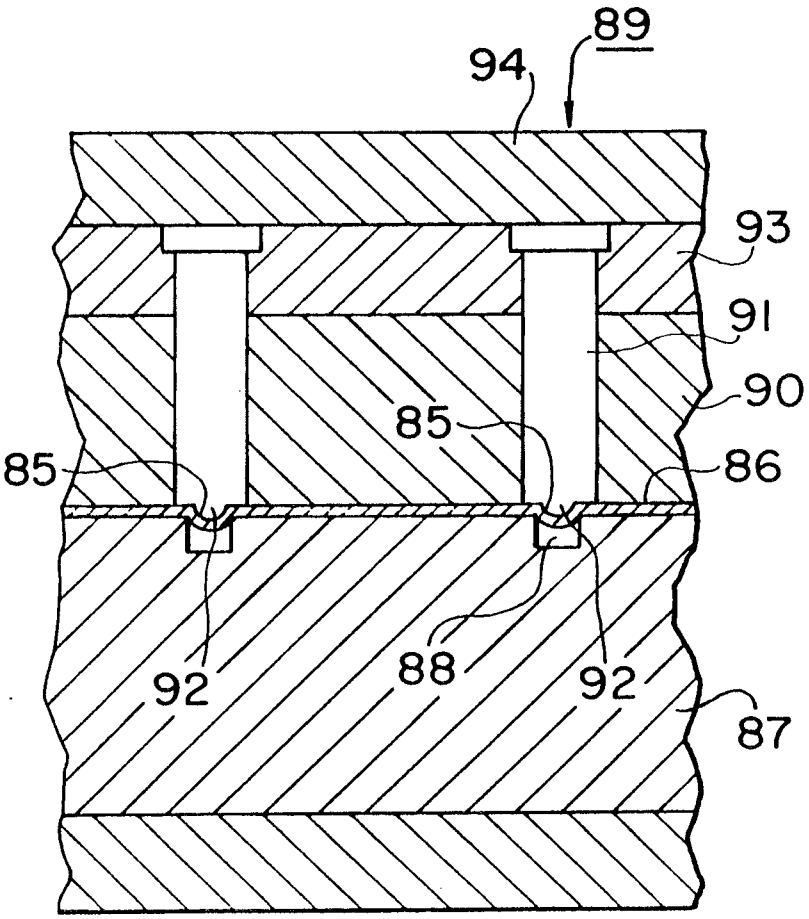
FIGS. 21A and 21B are vertical sectional views showing a groove forming step in the method according to the fourth embodiment of the present invention.
Figure 21A:
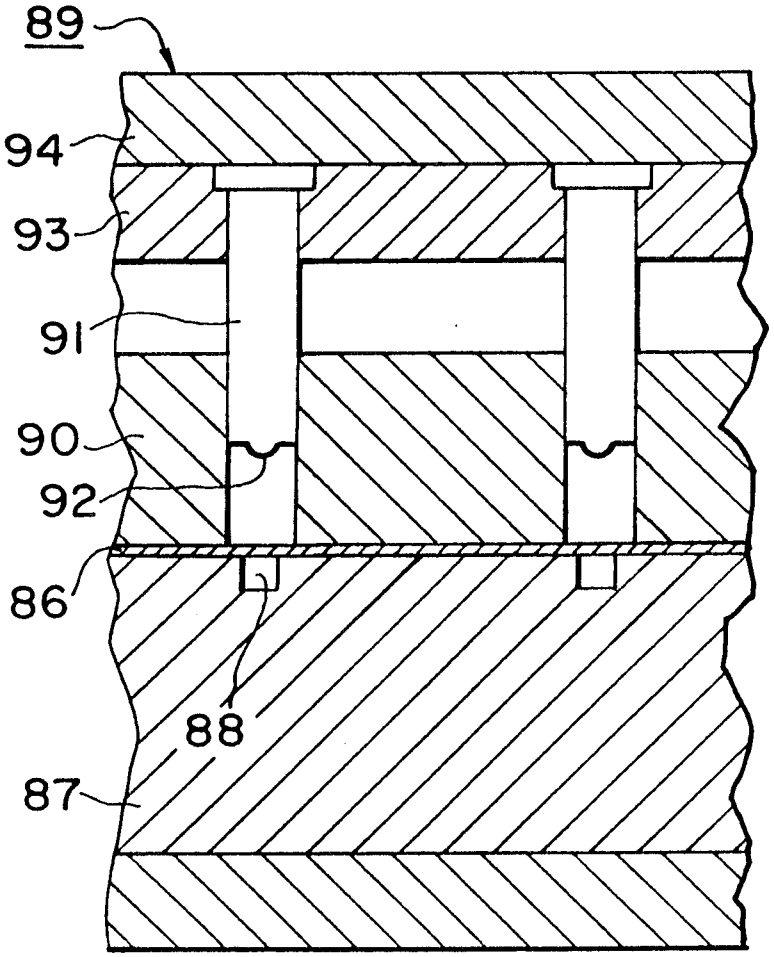
Figure 22:
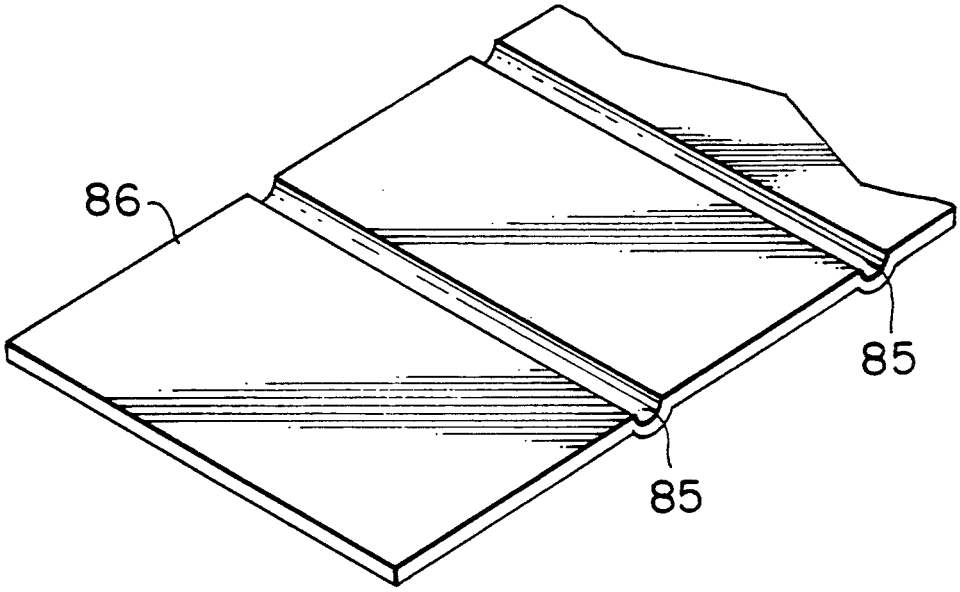
FIG. 22 is a perspective view of a raw plate after the groove forming step shown in FIGS. 21A and 21B.

In this embodiment, grooves 85 are first formed on one surface of a planar raw plate for a header pipe. As shown in FIG. 21A, a planar raw plate 86 is placed on a lower die 87 of a press machine 89. Die 87 is provided with grooves 88 on its upper surface. Planar raw plate 86 is fixed on lower die 87 by a punch guide 90 guiding punches 91 which have projections 92 at their bottom portions. Punches 91 fixed to a punch holder 93 are moved down along punch guide 90 by the downward motion of a dieset 94. The planar raw plate 86 is thereby pressed and bent by projections 92 of punches 91 to protrude the specified portions of the planar raw plate and form grooves 85, as shown in FIG. 21B. As a result, a planar raw plate 86 having grooves 85 as shown in FIG. 22 is obtained.

Figure 23A:
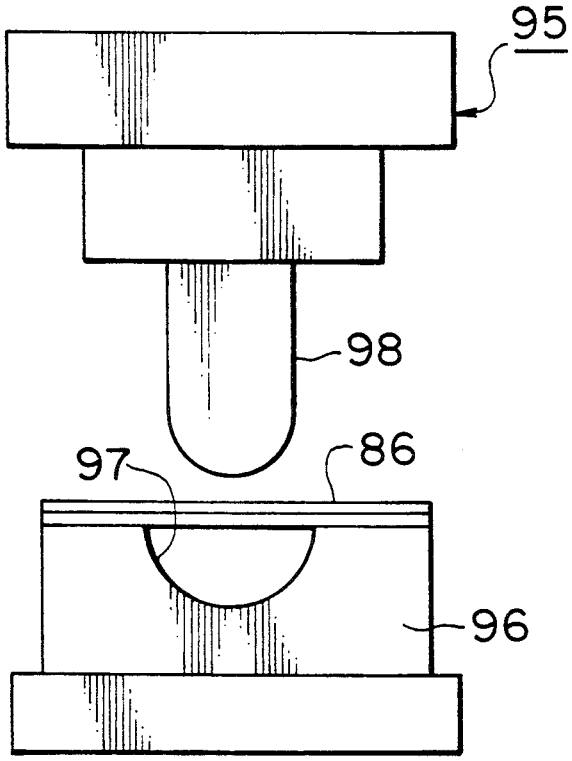
FIGS. 23A and 23B are side views showing a first bending step in the method according to the fourth embodiment of the present invention.
Figure 23B:
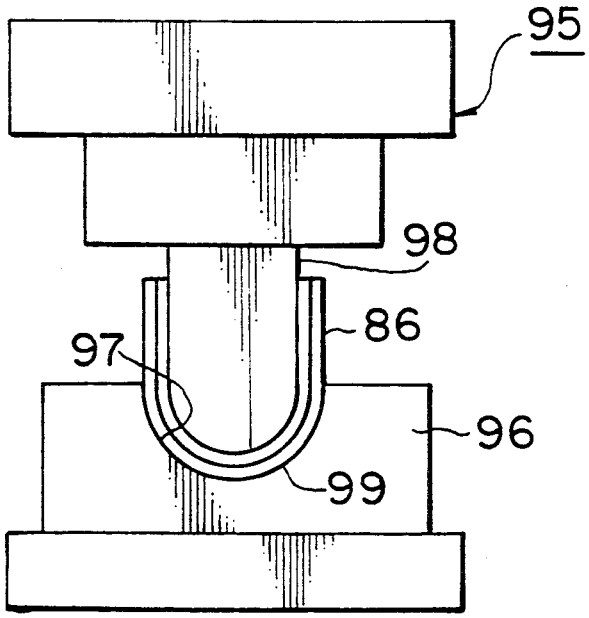

After the groove forming step, the method proceeds to a first bending step as shown in FIGS. 23A and 23B. Planar raw plate 86 is placed on a die 96 of a press machine 95. Die 96 has a semicircular groove 97 as shown in FIG. 23A. The placed planar raw plate 86 is then pressed by a punch 98 and bent to form a U-shaped raw plate 86 having a curved portion 99, as shown in FIG. 23B.

Figure 25:
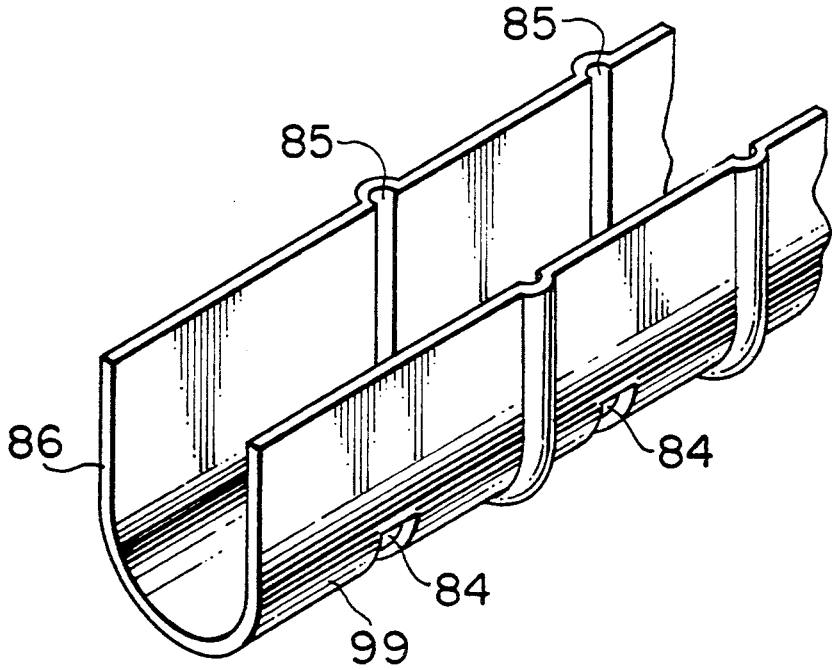
FIG. 25 is a perspective view of the raw plate after the connection hole opening step shown in FIGS. 24A and 24B.
Figure 24B:
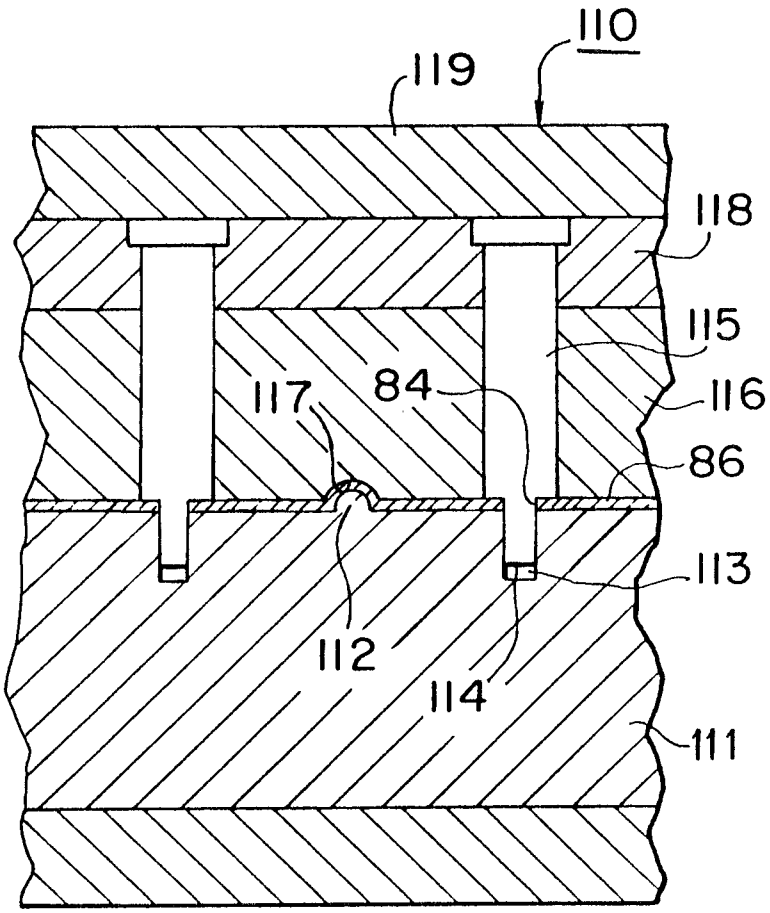
FIGS. 24A and 24B are vertical sectional views showing a connection hole opening step in the method according to the fourth embodiment of the present invention.
Figure 24A:
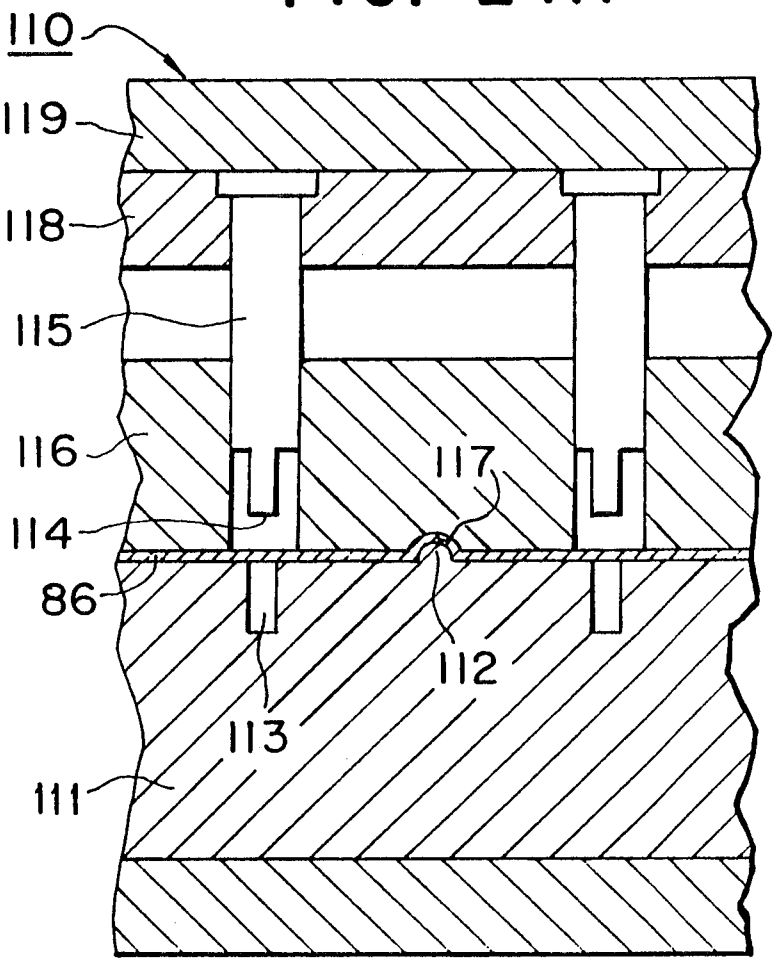

After the first bending step in the third embodiment, the method proceeds to a connection hole opening step as shown in FIGS. 24A and 24B. In this step, as shown in FIG. 24A, U-shaped raw plate 86 formed by the first bending step is inverted and placed on a die 111 of a press machine 110. Die 111 has an outer surface formed to correspond to the inner surface of the U-shaped raw plate, projections 112 formed to correspond to the shape of grooves 85, and grooves 113 for accommodating the insertion of cutting portions 114 of punches 115. The outer surface of the U-shaped raw plate 86 is held by a punch guide 116 which has grooves 117 on its lower surface. As shown in FIG. 24B, punches 115 fixed to a punch holder 118 are moved downward by the motion of a dieset 119. The cutting portions 114 of the punches 115 cut the curved portion of U-shaped raw plate 86 to open connection holes 84. As a result, a U-shaped raw plate 86 having connection holes 84 and grooves 85 is obtained as shown in FIG. 25.

Figure 26:
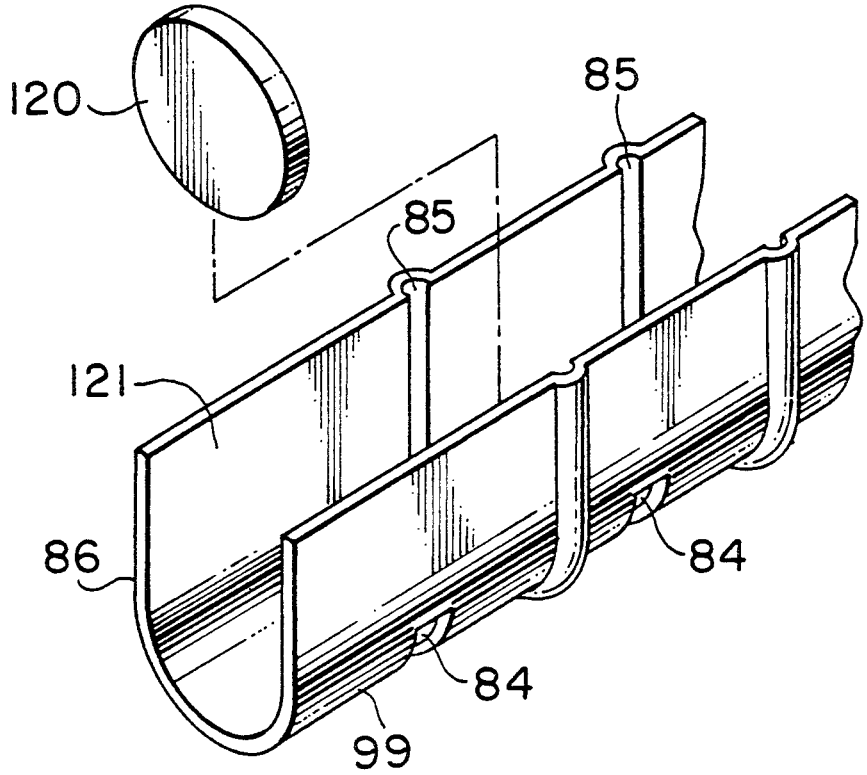
FIG. 26 is an exploded perspective view of a raw plate and a partition showing an inserting step in the method according to the third embodiment of the present invention.

After the connection hole opening step, the method proceeds to an inserting step for inserting partitions 120 into the inside of curved portion 99 of U-shaped raw plate 86 so that the peripheries of the partitions are inserted into the corresponding grooves 85 as shown in FIG. 26. Each partition 120 is inserted into the inside of curved portion 99 of U-shaped raw plate 86 through opening portion 121. The partitions are sized and shaped to snugly fit within grooves 85 and thereby be temporarily held in place.

Figure 28:
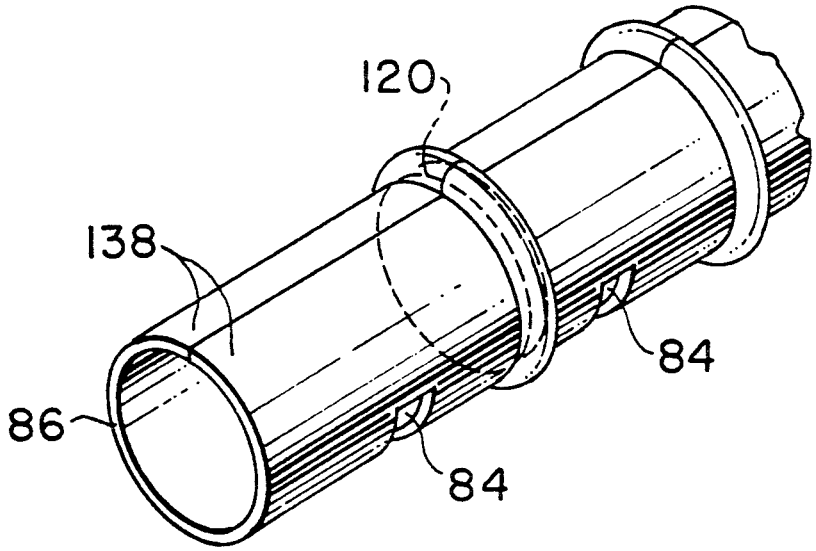
FIG. 28 is a perspective view of the raw plate after the the second bending step shown in FIGS. 27A and 27B.
Figure 27A:
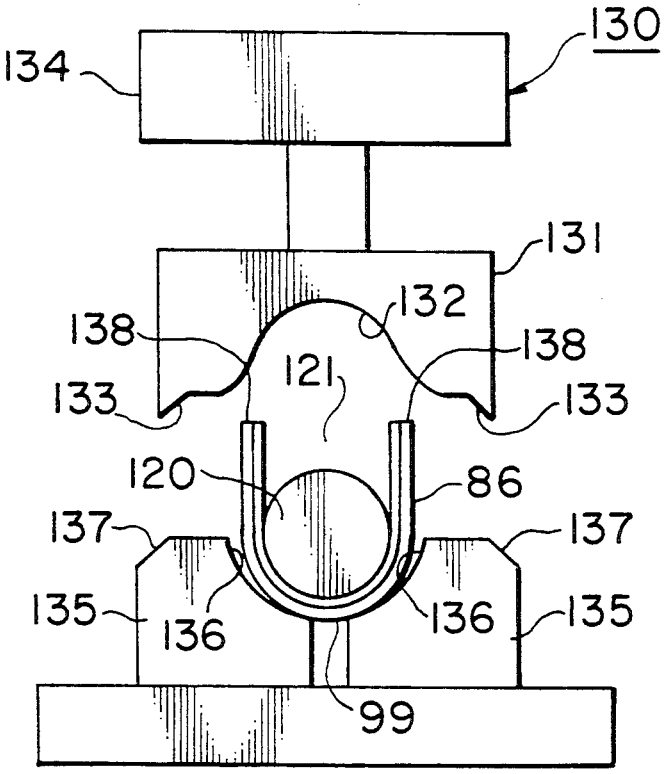
FIGS. 27A and 27B are side views showing a second bending step in the method according to the fourth embodiment of the present invention.
Figure 27B:
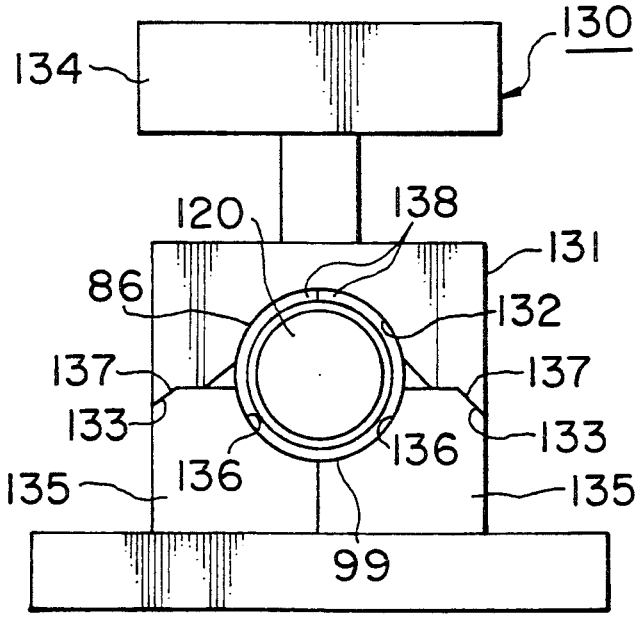

After the inserting step, the method proceeds to a second bending step as shown in FIGS. 27A and 27B. A press machine 130 is used which comprises upper die 131 with semicircular groove 132 and inclined surfaces 133, upper dieset 134, and a pair of movable die pieces 135 with arc-shaped surfaces 136 and inclined guide surfaces 137. Side portions 138 of U-shaped raw plate 86 are bent so that their terminal ends abut each other to form the cylindrical shape of the header pipe. Inserted partitions 120 are temporarily fixed in the raw plate 86 by the pressing operation of upper die 131 and movable die pieces 135. As a result, cylindrical raw plate 86 having connection holes 84 and partitions 120 inserted and fixed in grooves 85 is obtained as shown in FIG. 28.

Also in this third embodiment, since curved portion 99 of raw plate 86 is formed in the first bending step and connection holes 84 are opened directly on the curved portion in the successive connection hole opening step, the connection holes can be formed easily and precisely. Even if a deformation occurs on the side portions 138 of raw plate 86 in the connection hole opening step, the deformation can be easily corrected in the second bending step.

Moreover, because partitions 120 are inserted into grooves 85, the partitions are temporarily fixed in the raw plate more securely and more precisely to desired positions. Further in this embodiment, since grooves 85 are formed before the connection hole opening step, the positions and sizes of connection holes 84 opened in the connection hole opening step are the same positions and sizes of connection holes 84 after the header pipe is completed. Namely, it is not necessary for the connection hole opening step to take into account the shift of the wall of the raw plate in the longitudinal direction due to the groove forming step. Furthermore, grooves 85 formed by protruding a part of the wall of the raw plate can operate as ribs of the header pipe and increase the strength of the header pipe. Such a construction enables the header pipe to be formed from a thin plate.

Figure 29B:
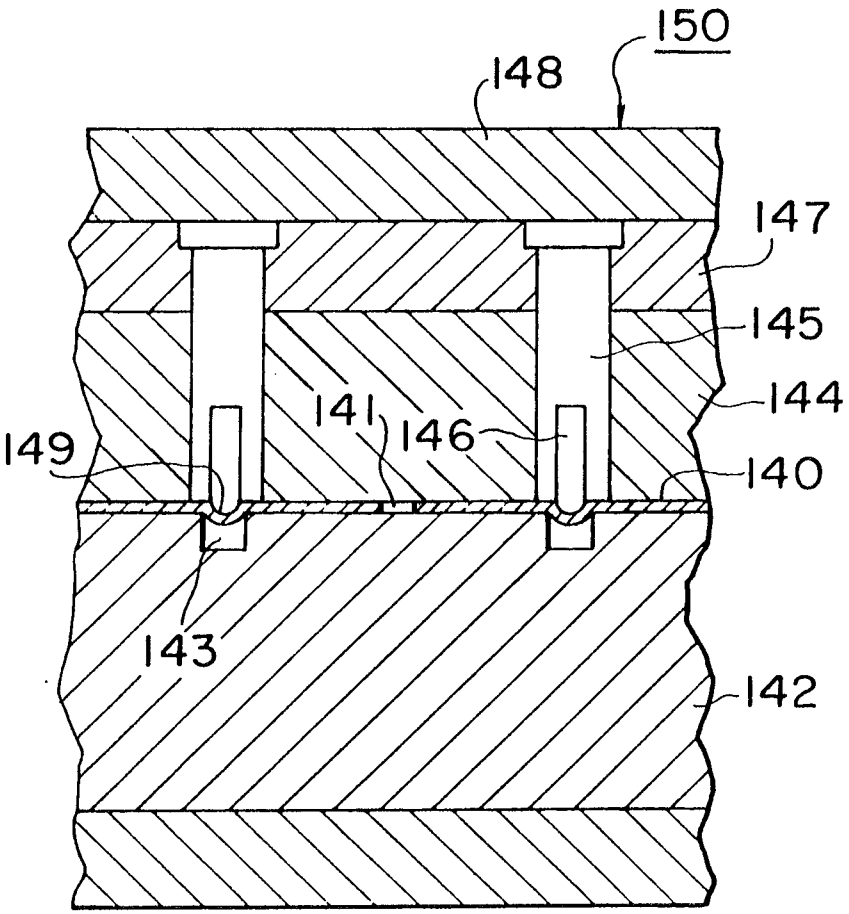
FIGS. 29A and 29B are vertical sectional views, showing a groove forming step according to a fifth embodiment (i.e., a modification of the fourth embodiment) of the present invention.
Figure 29A:
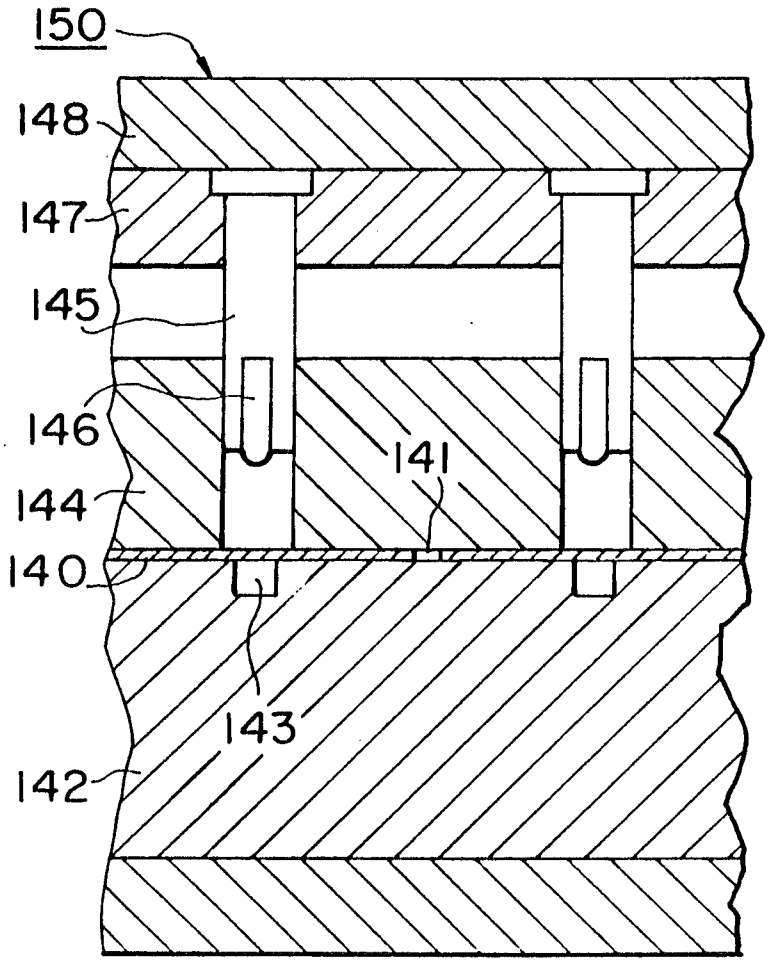
Figure 30:
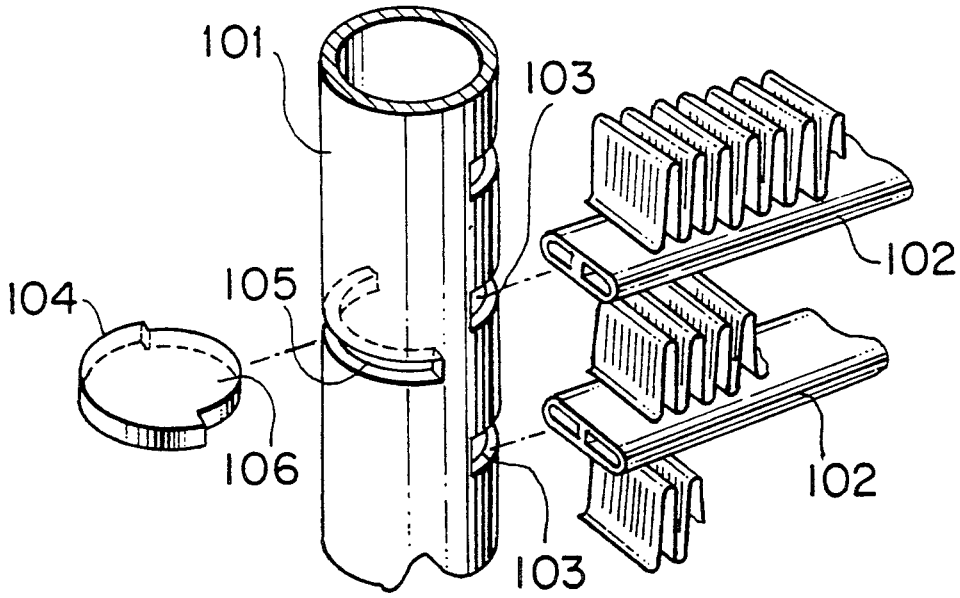
FIG. 30 PRIOR ART
FIG. 30 is an exploded perspective view of a conventional header pipe and the parts attached thereto in a conventional heat exchanger.

Although grooves 85 are preferably formed on a planar raw plate before the first bending step in the above embodiment, the groove forming step may be performed after the first bending step in the present invention. For example, as shown in FIGS. 29A and 29B, a U-shaped raw plate 140 with connection holes 141, after the first bending step and the connection hole opening step, is placed on a lower die 142 of a press machine 150. Die 142 is provided with grooves 143 on its upper surface. U-shaped raw plate 140 is fixed on lower die 142 by a punch guide 144 guiding punches 145. Punches 145 have projections 146 at their bottom portions. Punches 145 fixed to a punch holder 147 are moved downward along punch guide 144 by the downward motion of a dieset 148. U-shaped raw plate 140 is pressed and bent by projections 146 of punches 145 to protrude the specified portions of the raw plate and form grooves 149, as shown in FIG. 29B.

Alternatively, the groove forming step may be interposed between the first bending step and the connection hole opening step. Although this groove forming step is not shown by drawings, it can be easily understood from FIGS. 29A and 29B.

Although several preferred embodiments of the present invention have been described herein in detail, it will be appreciated by those skilled in the art that various modifications and alterations can be made to these embodiments without materially departing from the novel teachings and advantages of this invention. Accordingly, it is to be understood that all such modifications and alterations are included within the scope of the invention as defined by the following claims.

What is claimed is:

1. A method for manufacturing a header pipe of a heat exchanger, said pipe being formed as a cylindrical shape with a plurality of connection holes thereon for receiving heat exchanger tubes and with at least one partition therein for turning a heat medium in said header pipe, the method comprising the steps of:

bending a planar raw plate to have a U-shaped cross section defining a curved portion having an inner surface and opposed side portions each having a terminal end and an inner surface;

opening said connection holes on the curved portion of said raw plate formed by said first-mentioned bending step;

inserting said at last one partition having a periphery into the inside of the curved portion of said raw plate so that the periphery of said at least one partition is brought into contact with the inner surface of the curved portion of said raw plate; and bending the side portions of said raw plate inward so that the terminal ends of the side portions are abutted to each other and the inner surfaces of the side portions are brought into contact with the periphery of said at least one partition.

2. The method according to claim 1, wherein said planar raw plate is clad with a brazing material.

3. The method according to claim 1, wherein said planar raw plate has at least one groove into which the periphery of said at least one partition is inserted.

4. The method according to claim 1, wherein said at least one partition comprises a circular plate.

5. The method according to claim 1, wherein said at least one partition comprises a columnar block.

6. The method according to claim 1, wherein said at least one partition comprises a partition plate and a guide pipe provided on the periphery of said partition plate.

7. The method according to claim 1, wherein said at least one partition comprises a circular plate having a periphery which is formed as a semi-oval in cross section.

8. The method according to claim 1, wherein said at least one partition comprises a circular plate having a periphery which is formed as a triangle in cross section.

9. The method according to claim 1, wherein said at least one partition comprising a circular plate having a periphery and a projection on its periphery, and wherein a hole into which said projection is inserted is opened in said raw plate.

10. A method for manufacturing a header pipe of a heat exchanger, said header pipe being formed as a cylindrical shape with a plurality of connection holes thereon for receiving heat exchanger tubes and with at least one partition therein for turning head medium in said header pipe, the method comprising the steps of:

forming at least one groove, into which the periphery of said at least one partition is to be inserted, on one surface of a planar raw plate by protruding a part of said planar raw plate from the other surface of said planar raw plate;

bending said planar raw plate to have a U-shaped cross section defining a curved portion having an inner surface and opposed side portions each having a terminal end and an inner surface;

opening said connection holes on the curved portion of said raw plate formed by said first-mentioned bending step;

inserting said at least one partition having a periphery into said groove on the inner surface of the curved portion of said raw plate; and bending the side portions of said raw plate inward so that the terminal ends of the side portions are abutted to each other and the periphery of said at least one partition is inserted into said groove formed on the inner surfaces of the side portions of said raw plate.

11. The method according to claim 10, wherein said planar raw plate is clad with a brazing material.

12. A method for manufacturing a header pipe of heat exchanger, said header pipe being formed as a cylindrical shape with a plurality of connection holes thereon for receiving heat exchanger tubes and with at least one partition therein for turning a heat medium in said header pipe, the method comprising the steps of:

bending a planar raw plate, defining an inner surface and an outer surface, to have a U-shaped cross section defining a curved portion having an inner surface and opposed side portions each having a terminal end and an inner surface;

opening said connection holes on the curved portion of said raw plate formed by said first-mentioned bending step;

forming at least one groove, into which the periphery of said at least one partition is to be inserted, on the inner surface of said raw plate by protruding a part of said raw plate from the outer surface of said raw plate;

inserting said at least one partition having a periphery into said groove on the inner surface of the curved portion of said raw plate; and bending the side portions of said raw plate inward so that the terminal ends of the side portions are abutted to each other and the periphery of said at least one partition is inserted into said groove formed on the inner surfaces of the side portions of said raw plate.

13. The method according to claim 12, wherein said planar raw plate is clad with a brazing material.

14. A method for manufacturing a header pipe of heat exchanger, said header pipe being formed as a cylindrical shape with a plurality of connection holes thereon for receiving heat exchanger tubes and with at least one partition therein for turning a heat medium in said header pipe, the method comprising the steps of:

bending a planar raw plate, defining an inner surface and an outer surface, to have a U-shaped cross section defining a curved portion having an inner surface and opposed side portions each having a terminal end and an inner surface;

forming at least one groove, into which a periphery of said at least one partition is to be inserted, on the inner surface of said raw plate by protruding a part of said raw plate from the outer surface of said raw plate;

opening said connection holes on the curved portion of said raw plate formed by said first-mentioned bending step;

inserting said at least one partition having a periphery into said groove on the inner surface of the curved portion of said raw plate; and bending the side portions of said raw plate inward so that the terminal ends of the side portions are abutted to each other and the periphery of said at least one partition is inserted into said groove formed on the inner surfaces of the side portions of said raw plate.

15. The method according to claim 14, wherein said plane raw plate is clad with a brazing material.

* * * * *